US005948602A

United States Patent [19]

Yamashita et al.

[11] Patent Number: 5,948,602

[45] Date of Patent: Sep. 7, 1999

[54] METHOD FOR PROCESSING PHOTOGRAPHIC SILVER HALIDE PHOTOSENSITIVE ELEMENT

[75] Inventors: Seiji Yamashita; Eiichi Okutsu, both of Kanagawa, Japan

[73] Assignee: Fuji Photo Film Co., Ltd., Kanagawa, Japan

[21] Appl. No.: 09/063,865

[22] Filed: Apr. 21, 1998

[30] Foreign Application Priority Data

Apr. 21, 1997 [JP] Japan ..... 9-117559
Jun. 18, 1997 [JP] Japan ..... 9-177639

[51] Int. Cl.[6] ..... G03C 5/29
[52] U.S. Cl. ..... 430/440; 430/446
[58] Field of Search ..... 430/440, 446

[56] References Cited

U.S. PATENT DOCUMENTS 5,780,209 7/1998 Yamashita ..... 430/440
5,821,041 10/1998 Okutsu et al. ..... 430/440

*Primary Examiner*—Hoa Van Le
*Attorney, Agent, or Firm*—Burns, Doane, Swecker & Mathis, L.L.P.

[57] ABSTRACT

When a double-sided photographic silver halide photosensitive element having a crossover light quantity of up to 15% is processed through an automatic processor, it is developed with a developer containing an ascorbic acid type developing agent. By restricting the drag-out of the developer to 1.0 ml or less per 10×12-inch size sheet, the photosensitive element can be processed and effectively dried so as to produce high-quality images free of residual color.

20 Claims, No Drawings

METHOD FOR PROCESSING PHOTOGRAPHIC SILVER HALIDE PHOTOSENSITIVE ELEMENT

This invention relates to a method for processing a photographic silver halide photosensitive element having a photosensitive silver halide emulsion layer on either surface through an automatic processor and more particularly, to a method for processing a medical radiographic photosensitive material in such a manner as to minimize waste solution while producing sharp images. It also relates to a method for processing a photographic black-and-white silver halide photosensitive element in such a manner as to substantially eliminate the odor of a fixer and reduce the drying load after water washing while reducing the replenishment of the fixer.

BACKGROUND OF THE INVENTION

For finding a satisfactory compromise among rapid processing, low-waste processing, and image quality improvement by a sharpness increase due to antihalation and crossover cutting effects, various measures have been taken for increasing the rate of discharge of the dyes in the antihalation layer and crossover cutting layer out of the system during rapid processing.

JP-B 8333/1974 representing the technology of the early years discloses the use of water-soluble dyes in anti-halation layers. JP-A 70830/1987 and 126645/1989 disclose the use of dye-mordanted layers for crossover cutting.

JP-B 5574/1976 and JP-A 172828/1989 disclose the use of solid dispersions of water-soluble dyes as antihalation layers and crossover cutting layers. Also, the technique of causing dyes to be adsorbed to solid particle dispersions, especially silver halide fine grain crystals, and using them in crossover cutting layers and antihalation layers is disclosed, for example, in JP-A 29641/1990, 73336/1989, 194251/1988, 46438/1988, and JP-B 20688/1996.

The above-referred JP-A 172828/1989 describes solid dispersions of dyes, and JP-A 126645/1989 describes crossover cutting layers in which dyes are affixed with mordants. The technique of increasing the absorption of spectral sensitizing dyes is also well known in the art.

Since these techniques are based on the concept that the photosensitive element is prevented from residual color by dissolving coloring matter into processing solution, the photosensitive element should have a relatively high swelling factor. Since the photosensitive element carries the colored solution of the preceding bath to the subsequent bath, the potential problems of coloring of the processing solution and deposition of dyes become revealed with the advance of low-replenishment, low-waste and rapid processing. In particular, the solid dispersion of an alkali-soluble dye described in JP-A 172828/1989 reveals the problem of precipitation in solution and on rollers if it is carried over to the fixing and subsequent steps.

An aluminum-containing hardening fixer must be of low pH design set at pH 5 or lower for the stabilization of aluminum ions. For such a fixer, the automatic processor must be equipped with a duct for removing the odor of sulfurous acid and acetic acid. If the fixer is designed as a non-hardening one free of aluminum ions in order to solve the odor problem, the drag-out of the fixer by the photosensitive element is increased so that more of the dye to be dissolved out for decolorization by fixing treatment may be carried over to water washing and subsequent steps, eventually increasing the dye deposit in the washing tanks and on rollers.

For these reasons, it is impossible in the state-of-the-art to further reduce the replenishment and waste of processing solution and to further improve the quality of images by increasing sharpness.

On the other hand, solutions for use in processing photographic black-and-white silver halide photosensitive elements, for example, developers and fixers, especially fixers give oft odor and corrosive vapor which are serious factors detrimental to the environment where the processor is located. In the prior art, a forced ventilation duct is attached to the processor for forcedly discharging the gas, or the gas is passed through a filter of activated carbon or the like to remove odorous components. A number of automatic processors of the forced ventilation design and processing systems having such processors built therein are now commercially available, for example, under the trade name of CEPROS 30, CEPROS M2, CEPROS S, and CEPROS P from Fuji Photo Film Co., Ltd.

From the standpoint of reducing odor, it is known to set a fixer at pH 4.5 or higher for suppressing the generation of sulfurous acid gas. It is also known that aluminum ions commonly used as the hardening agent in the fixer are more likely to precipitate as the pH of the fixer becomes higher. Although this problem may be solved by removing aluminum ion as the hardening agent, the absence of aluminum ion leaves the film swollen at the end of fixation so that the photosensitive element may have a very high water content at the end of water washing, becoming an obstruction against rapid processing within 90 seconds from development to drying.

A substantial decline of the fixer concentration is also effective for reducing odor, but at the sacrifice of fixing capability, especially a fixing rate. This is especially outstanding in medical radiographic photosensitive elements which are required to have high sensitivity. Since the radiographic photosensitive elements have a relatively high silver content and mostly use silver iodobromide emulsions in order to achieve a high sensitivity, they cannot be fixed at a low concentration of fixing agent.

Rapid drying is possible with the non-hardening fixer if the photosensitive element has previously been hardened to an excessive degree as typified by a swelling factor of up to 130%. However, the swelling of the photosensitive element during development and fixation is also significantly suppressed, leading to several undesirable problems including a sensitivity decline, a loss of covering power (blackening density per unit quantity of developed silver), worsening of residual color, and short fixation.

SUMMARY OF THE INVENTION

A primary object of the present invention is to provide a method for processing a photographic silver halide photosensitive element, with crossover light fully cut, through an automatic processor in a rapid, low-replenishment fashion so that medical radiographic images of quality may be formed without residual color while suppressing deposition of dyes in processing solutions and on rollers.

Another object of the present invention is to use an odorless fixer, thereby enabling the use of an unducted automatic developer.

A further object of the present invention is to use multistage water washing, thereby eliminating a need for piping to the processor and thus allowing the processor to be installed at any site.

A still further object of the present invention is to provide a method for processing a photographic silver halide photosensitive element through an automatic processor, which overcomes the problems of fixing capability and drying losses resulting from low replenishment of the fixer, renders the fixer odorless, and eliminates a forced ventilation duct from the processor.

According to the present invention, there is provided a method for processing a photographic silver halide photosensitive element having a photosensitive silver halide emulsion layer on either surface of a support and a crossover light quantity of up to 15% using an automatic processor, comprising the steps of developing the photosensitive element with a developer, fixing with a fixer, and then washing with water. The developer contains an ascorbic acid compound as a developing agent. In the step of developing the photosensitive element with the developer, the drag-out of the developer which is carried over by the photosensitive element is restricted to 1.0 ml or less per 10×12-inch size sheet of the photosensitive element.

Preferably, in the step of fixing the photosensitive element with the fixer, the drag-out of the fixer is restricted to 1.0 ml or less per 10×12-inch size sheet.

Typically, the step of washing the photosensitive element with water is a multi-stage washing step including at least a first washing tank and a last washing tank. In preferred embodiments, the drag-out of wash water from the first washing tank is restricted to 1.0 ml or less per 10×12-inch size sheet, the drag-out of wash water from the last washing tank to a drying zone is restricted to 1.0 ml or less per 10×12-inch size sheet, and/or substantially no waste solution of wash water is left after the washing step.

At least one of the photosensitive silver halide emulsion layers is preferably comprised of an emulsion of tabular silver halide grains having an average aspect ratio of at least 2 and further preferably having a silver chloride content of at least 50 mol %.

Preferably, the photosensitive element contains a coverage of a hydrophilic colloid and a coverage of a polymer latex, the polymer latex coverage being at least 10% by weight of the colloid coverage, and the photosensitive element has a swelling factor with water of up to 150%.

Preferably the fixer contains at least 0.15 mol/liter of succinic acid.

It is noted that the drag-out of a solution is an amount of the solution that is carried over from its bath by the photosensitive element and that the coverage of a component is a coating weight, that is, a weight of the component coated on a support, typically per square meter of the photosensitive element.

DETAILED DESCRIPTION OF THE INVENTION

The photographic silver halide photosensitive element to be processed according to the invention is a double-side photosensitive element having a photosensitive silver halide emulsion layer on either surface of a support and a crossover light quantity of up to 15%. Using an automatic processor, it is processed in the order of steps of development, fixation, and washing (inclusive of "stabilization"). The developing step uses a developer which contains a developing agent selected from ascorbic acid compounds which are less toxic than hydroquinone and analogues. In the step of processing the photosensitive element with the developer, the developer is carried over in an amount of up to 1.0 ml per quarter-size (10×12 inches) sheet of the photosensitive element.

With these requirements met, even a rapid, low-replenishment process can produce images which are improved in sharpness, and eliminate the undesirable influence of the dye used for sharpness improvement such as residual color. In contrast, a crossover light quantity in excess of 15% leads to a low sharpness. If the drag-out of the developer by the photosensitive element is in excess of 1.0 ml per quarter-size sheet, a more fraction of the dye dissolved out of the photosensitive element is carried over to the subsequent step, giving rise to problems including coloring of processing solutions, deposition of the dye on rollers, and residual color.

As described above, the method for processing the photosensitive element described above includes fixation with a fixer and washing with wash water (inclusive of "stabilizer solution"). In preferred embodiments of the invention, the drag-out of the fixer and/or wash water is also restricted to 1.0 ml or less per quarter-size (10×12 inches) sheet. In a further preferred embodiment wherein washing is carried out in a plurality of stages for increasing the washing efficiency, the drag-out of wash water from the first washing tank is restricted to 1.0 ml or less per quarter-size sheet and especially, the drag-out of wash water from the last washing tank to a drying zone is restricted to 1.0 ml or less per quarter-size sheet.

In the multi-stage water washing, a multi-stage counter-flow system of replenishing water from the last washing tank and sequentially feeding the overflow of a later stage tank to a preceding stage tank is preferably employed. If the overflow or wastewater of the first washing tank is used in the preparation of a fixer replenisher, the waste solution of wash water is substantially eliminated, that is, the waste solution of wash water can be reduced to 1.50 ml or less per square meter of the photosensitive element, especially 0 ml.

The restricted drag-out(s) can be accomplished by various means, preferably by controlling the coverages of hydrophilic colloid and polymer latex in the photosensitive element so as to fall in a specific ratio range and controlling the swelling factor with water of the photosensitive element so as to fall in a specific range.

From the standpoints of photographic properties and fixing capability, a high silver chloride tabular grain emulsion is preferably used as the emulsion layer. Although the photosensitive element using such an emulsion is susceptible to silver staining or sludging, the restricted drag-out is effective for reducing sulfite ions for thereby suppressing silver sludging. From the standpoint of preventing silver sludging, it is preferred to reduce the amount of a sulfite preservative. However, since the photosensitive element of the invention typically uses a dye which is decolorizable with a sulfite ion as will be described later, the reduced amount of the sulfite preservative gives rise to the problem that the dye is insufficiently decolorized. In such a situation, the residual color and other problems can be eliminated by restricting the drag-out of the solution by the photosensitive element as specified above.

The fixer used herein is preferably a non-hardening fixer substantially free of aluminum ion, which allows for higher pH setting and eliminates the odor of sulfurous acid. Even when a non-hardening fixer is used, neither worsening of residual color nor short drying is induced because the drag-out of the solution by the photosensitive element is restricted as specified above. As to the automatic processor, neither duct nor piping is necessary.

In order to produce sharp images, the photosensitive element of the invention should have a crossover light quantity of 15% or less. This is generally accomplished by providing a crossover light cutting layer between the photosensitive emulsion layer and the support. To the crossover light cutting layer, a dye corresponding to the photosensitive wavelength region is added. Any desired dye may be used insofar as no detrimental absorption is left after development. The dye is often added in the form of a solid particle dispersion. The method of adding dyes in solid particle dispersion form is described, for example, in JP-A 264936/1990, 210553/1991, 210554/1991, 238447/1991, 14038/1992, 14039/1992, 125635/1992, 338747/1992, and 27589/1994. The dyes which can be used herein include dyes of the general formulae (I) to (VII) in JP-A 211542/1992, specifically Compounds I-1 to I-37, II-1 to II-6, III-1 to III-36, IV-1 to IV-16, V-1 to V-6, VI-1 to VI-13, and VII-1 to VII-5 illustrated therein; dyes of the general formula (1) in JP-A 73767/1996, specifically Compounds 1 to 6 illustrated therein; and dyes of the general formulae (VIII) to (XII) in JP-A 87091/1996, specifically Compounds VIII-1 to VIII-5, IX-1 to IX-10, X-1 to X-21, XI-1 to XI-6, and XII-1 to XII-7 illustrated therein.

Other useful methods include a method of causing well-known dyes to be adsorbed to mordants, a method of dissolving well-known dyes in oil followed by emulsifying dispersion like oil droplets, a method of causing dyes to be adsorbed on surfaces of inorganic materials as disclosed in JP-A 5748/1991, and a method of causing dyes to be adsorbed to polymers as disclosed in JP-A 298939/1990. The provision of the crossover light cutting layer to the photosensitive element may be carried out by the methods described in the above-referred patents. Of these dyes, those compounds which are readily decolorizable with a sulfite ion in the developer are preferably used.

Using any of the above-described methods, the photosensitive element of the invention is adjusted to a crossover light quantity of up to 15%, preferably 3 to 15%, more preferably 5 to 10%. To achieve an extremely-small crossover light quantity, an extremely large amount of the dye might be coated, causing residual color and other problems and achieving no further improvement in sharpness. A crossover light quantity in excess of 15% is undesirable because the sharpness of images becomes low independent of imaging sites.

The amount of the dye added is not critical insofar as the crossover light quantity can be reduced to 15% or lower. Most often, the amount of the dye added is preferably about 5 mg to about 200 mg per square meter of the photosensitive element although it varies with a particular dye.

Polymer latex

In the photosensitive element of the invention, a polymer latex is often used. The term "polymer latex" designates a polymer itself and is thus used herein in a different sense from the usual "latex" designating a suspension in which a polymer is dispersed in water in a colloidal state under the action of an emulsifying agent.

One useful polymer latex is a core-shell polymer latex as disclosed in U.S. Pat. No. 5,561,034, and specifically, latex LAT1 to LAT8 described in Examples thereof. With respect to the monomer type, glass transition temperature and other properties of polymer latices, reference should be made to U.S. Pat. No. 5,561,034, col. 3, line 45 to col. 10, line 27. Another useful polymer latex family is disclosed in JP-A 220669/1996 and specifically, Compounds I-1 to I-16 and P-1 to P-12 described therein.

In the photosensitive element of the invention, a polymer latex obtained by polymerizing substantially insoluble monomers is preferably used. This polymer latex and the monomers used therefor are described in detail.

The monomers are preferably acrylate compounds, especially mixtures of an acrylate compound and a methacrylate compound. The polymer latex should preferably have a particle size of up to 300 nm.

The polymer latex is preferably prepared by polymerizing the monomers in the presence of a water-soluble polymer and/or a surfactant.

The surfactants used in the polymerization of monomers to form the polymer latex include anionic, nonionic, cationic and ampholytic surfactants, with the anionic and/or nonionic surfactants being preferred. The anionic and nonionic surfactants used herein may be selected from a variety of compounds well known in the art. Most preferred are anionic nonionic surfactants.

The water-soluble polymers used in the polymerization of monomers to form the polymer latex include synthetic polymer and naturally occurring polymers, either of which may be advantageously used herein. The synthetic water-soluble polymers include those having in their molecular structure nonionic groups, anionic groups, cationic groups, nonionic and anionic groups, nonionic and cationic groups, and anionic and cationic groups. Exemplary nonionic groups are ether groups, alkylene oxide groups, hydroxyl groups, amide groups and amino groups. Exemplary anionic groups are carboxylic acid groups and salts thereof, phosphoric acid groups and salts thereof, sulfonic acid groups and salts thereof. Exemplary cationic groups are quaternary ammonium groups and tertiary amino groups.

The naturally occurring water-soluble polymers include those having in their molecular structure nonionic groups, anionic groups, cationic groups, nonionic and anionic groups, nonionic and cationic groups, and anionic and cationic groups.

Of the water-soluble polymers used in the polymerization of monomers to form the polymer latex, those having anionic groups and those having nonionic and anionic groups are preferable whether they are synthetic or natural polymers.

The water-soluble polymers have a solubility of at least 0.05 g, especially at least 0.1 g in 100 g of water at 20° C.

Examples of the natural water-soluble polymers are described in "Comprehensive Technical Data Collection of Water-Soluble High-molecular Weight Water Dispersion Resins," and include lignin, starch, pluran, cellulose, dextran, dextrin, glycogen, alginic acid, gelatin, collagen, guar gum, gum arabic, laminaran, lichenan, nigeran and derivatives thereof. Preferred derivatives of natural water-soluble polymer are sulfonate, carboxylate, phosphate, sulfoalkylene, carboxyalkylene, and alkyl phosphate derivatives and salts thereof. Glucose, gelatin, dextran, cellulose and derivatives thereof are especially preferred.

The polymer latex can be readily prepared by various techniques. Exemplary techniques are an emulsion polymerization technique and a technique of once forming a polymer by solution polymerization or bulk polymerization and dispersing the polymer again.

In the case of emulsion polymerization, a polymer latex is prepared by using water as a dispersing medium, 10 to 50% by weight based on water of a monomer, 0.05 to 5% by weight based on the monomer of a polymerization initiator, and 0.1 to 20% by weight based on the monomer of a dispersant, and effecting polymerization with stirring at about 30 to 100° C., preferably 60 to 90° C. for about 3 to 8 hours. The monomer concentration, initiator amount, reaction temperature and time may be easily changed in a wide range. Exemplary initiators are water-soluble peroxides (e.g., potassium persulfate and ammonium persulfate) and water-soluble azo compounds (e.g., 2,2'-azobis(2-aminodipropane)-hydrochloride). Exemplary dispersants are water-soluble polymers as well as anionic, nonionic, cationic and ampholytic surfactants, alone or in admixture. Preferably a water-soluble polymer is used in admixture with a nonionic or anionic surfactant.

In the case of solution polymerization, a polymer latex is prepared by dissolving a mixture of monomers in a suitable solvent (e.g., ethanol, methanol and water) in a suitable concentration (usually less than 40% by weight, preferably 10 to 25% by weight based on the solvent) and heating the solution at an appropriate temperature (e.g., 40 to 120° C., preferably 50 to 100° C.) in the presence of a polymerization initiator (e.g., benzoyl peroxide, azobisisobutyronitrile and ammonium persulfate), thereby effecting copolymerization reaction. The reaction mixture is then poured into a medium in which the resultant copolymer is not soluble, whereupon the product settles out. By subsequent drying, the unreacted mixture is separated.

Next, the copolymer is dissolved in a solvent in which the copolymer is soluble, but which is insoluble in water (e.g., ethyl acetate or butanol). The mixture is vigorously dispersed in the presence of a dispersant (e.g., surfactants and water-soluble polymers) whereupon the solvent is distilled off, yielding a polymer latex.

The synthesis of polymer latices is discussed, for example, in U.S. Pat. No. 2,852,386, 2,853,457, 3,411,911, 3,411,912, 4,197,127, Belgian Patent No. 688,882, 691,360, 712,823, JP-B 5331/1970, JP-A 18540/1985, 130217/1976, 137831/1983, and 50240/1980.

Polymer latices having a mean particle size of 0.5 to 300 nm, especially 30 to 250 nm are preferably used. The particle size of polymer latices can be measured by an electron microscope technique, soap titration, light scattering, and centrifugation as described in "The Chemistry of Polymer Latex," Kobunshi Kankokai, 1973. The light scattering method is preferred. One exemplary meter based on light scattering is DLS700 by Otsuka Electronics K.K.

No particular limit is imposed on the molecular weight of the polymer latex although an overall molecular weight of about 1,000 to 1,000,000, especially about 2,000 to 500,000 is preferred.

In the practice of the invention, the polymer latex can be contained in a photographic layer as such or as a dispersion in water.

Several illustrative, non-limiting examples of the polymer latex are given below together with the dispersant used in the synthesis thereof. A suffix attached to a monomer unit represents a percent content (% by weight).

| | | dispersant |
|---|---|---|
| Lx-1 | $-(CH_2-CH)_{100}-$ <br> $\quad\quad\quad

-continued
| | | dispersant |
|---|---|---|
| Lx-7 | 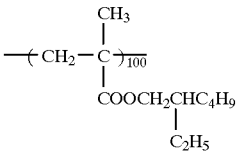 | dispersant dextran sulfate |
| Lx-8 | 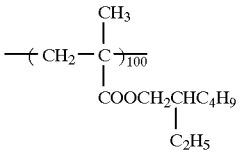 | Pf-4 |
| Lx-9 | 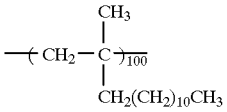 | Sf-1 |
| Lx-10 | 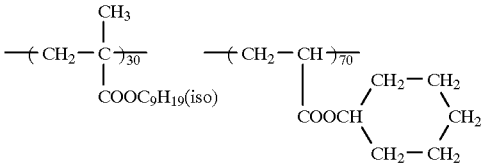 | Sf-2 |
| Lx-11 | 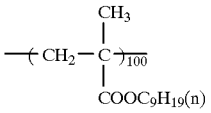 | Sf-1 |
| Lx-12 | 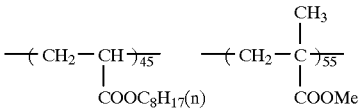 | Sf-3 |
| Lx-13 | 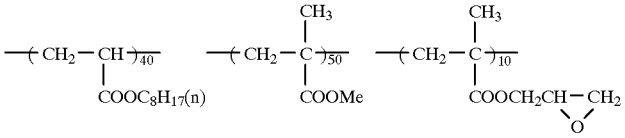 | Sf-4 |
| Lx-14 | 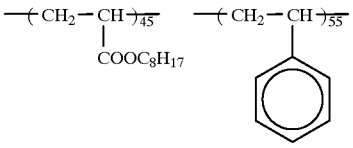 | Sf-3 |
| Lx-15 | 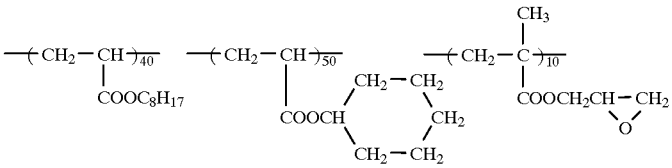 | P-2 |
| Lx-16 | 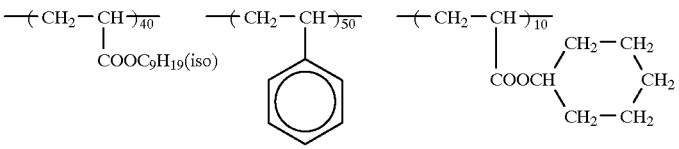 | P-3 |

-continued
| | | dispersant |
|---|---|---|
| Lx-17 | 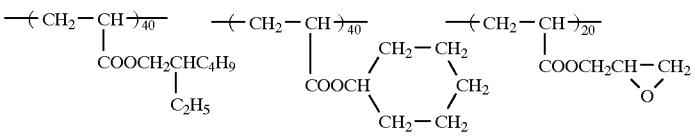 | Sf-1 |
| Lx-18 | 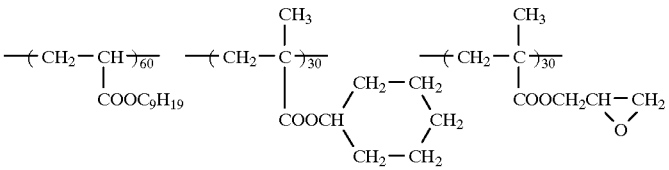 | P-3 |
| Lx-19 | 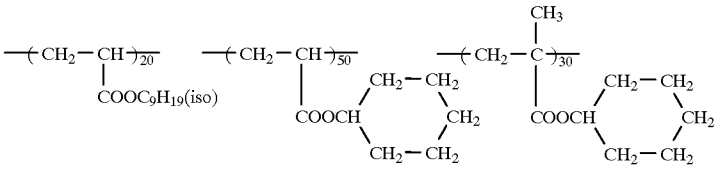 | P-2<br>Sf-3 |
| Lx-20 | 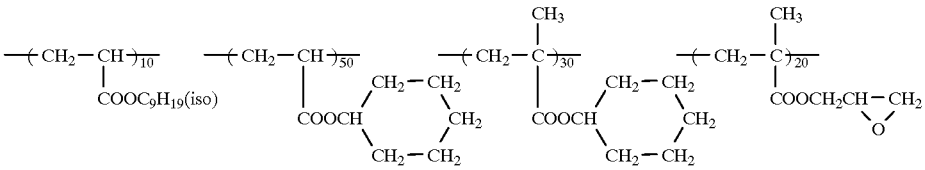 | P-2<br>Sf-3 |
| Lx-21 | 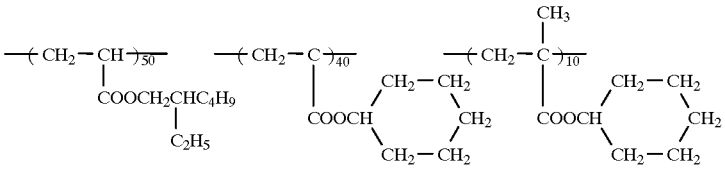 | Sf-3 |
Sf-1
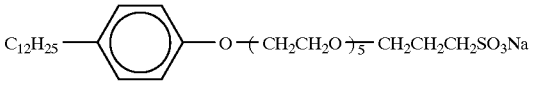
Sf-2
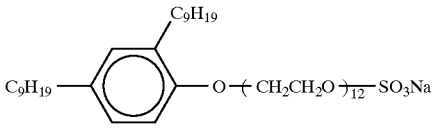
Sf-3
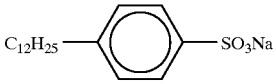
Sf-4 $C_{12}H_{25}OSO_3Na$
P-1
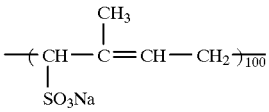
Mw = 5000

-continued

| | | dispersant |
|---|---|---|
| P-2 | 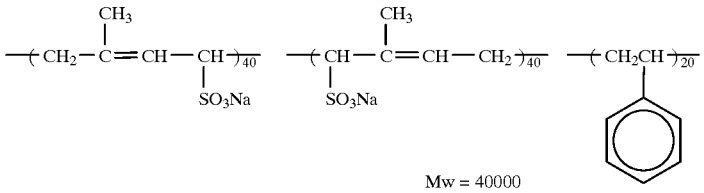 Mw = 40000 | |
| P-3 | 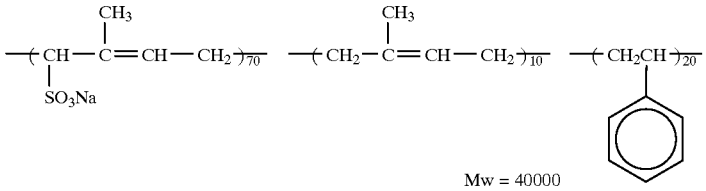 Mw = 40000 | |
| P-4 | 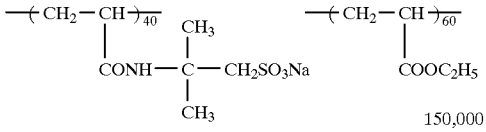 150,000 | |

Besides, polymer latices of the core/shell type are also preferably used in the photosensitive element of the invention.

Preferred, non-limiting compound examples of the core/shell polymer latex are given below. The structure of latex compound is described in the order of core polymer structure, shell polymer structure, and core/shell ratio. In each polymer, the comonomer compositional ratio and the core/shell ratio are expressed in % by weight.

| | |
|---|---|
| Lx-22 to Lx-33 | |
| Core: styrene/butadiene copolymer (37/63) | |
| Lx-22 shell: styrene/M-1 (98/2) | core/shell = 50/50 |
| Lx-23 shell: styrene/M-1 (96/4) | core/shell = 50/50 |
| Lx-24 shell: styrene/M-1 (92/8) | core/shell = 50/50 |
| Lx-25 shell: styrene/M-1 (84/16) | core/shell = 50/50 |
| Lx-26 shell: styrene/M-1 (68/32) | core/shell = 50/50 |
| Lx-27 shell: styrene/M-1 (84/16) | core/shell = 67/33 |
| Lx-28 shell: styrene/M-1 (84/16) | core/shell = 85/15 |
| Lx-29 shell: n-butyl acrylate/M-1 (96/4) | core/shell = 50/50 |
| Lx-30 shell: n-butyl acrylate/M-1 (92/8) | core/shell = 50/50 |
| Lx-31 shell: n-butyl acrylate/M-1 (84/16) | core/shell = 50/50 |
| Lx-32 shell: methyl acrylate/M-5 (84/16) | core/shell = 50/50 |
| Lx-33 shell: styrene/methyl acrylate/M-3 (21/63/16) | core/shell = 50/50 |
| Lx-34, 35 | |
| core: styrene/butadiene copolymer (22/78) | |
| Lx-34 shell: styrene/M-2 (84/16) | core/shell = 50/50 |
| Lx-35 shell: n-butyl acrylate/M-6 (84/16) | core/shell = 50/50 |
| Lx-34 to Lx-41 | |
| core: butadiene homopolymer (100) | |
| Lx-36 shell: styrene/M-1 (84/16) | core/shell = 50/50 |
| Lx-37 shell: ethyl acrylate/M-5/methacrylic acid (65/15/20) | core/shell = 75/25 |
| Lx-38 shell: n-butyl acrylate/M-1 (84/16) | core/shell = 50/50 |
| Lx-39 shell: n-butyl acrylate/M-2 (84/16) | core/shell = 50/50 |
| Lx-40 shell: 2-ethylhexyl acrylate/M-2 (84/16) | core/shell = 50/50 |
| Lx-41 shell: n-butyl acrylate/M-7 (84/16) | core/shell = 50/50 |
| Lx-42 to Lx-44 | |
| core: isoprene homopolymer (100) | |
| Lx-42 shell: styrene/acrylonitrile/M-1 (63/21/16) | core/shell = 90/10 |

-continued

| | |
|---|---|
| Lx-43 shell: methyl methacrylate/ethyl acrylate/M-2/sodium 2-acrylamido-2-methylpropanesulfonate (15/65/15/5) | core/shell = 75/25 |
| Lx-44 shell: styrene/M-1 (84/16) | core/shell = 20/80 |
| Lx-45 to Lx-47 | |
| core: styrene/butadiene copolymer (49/51) | |
| Lx-45 shell: styrene/butyl acrylate/M-1 (26/60/15) | core/shell = 50/50 |
| Lx-46 shell: M-1 (100) | core/shell = 90/10 |
| Lx-47 shell: lauryl methacrylate/butyl acrylate/M-5 (30/55/15) | core/shell = 40/60 |
| Lx-48 | |
| core: acrylonitrile/styrene/butadiene copolymer (25/25/50) | |
| shell: butyl acrylate/M-1 (92/8) | core/shell = 50/50 |
| Lx-49 | |
| core: ethyl acrylate/butadiene copolymer (50/50) | |
| shell: styrene/divinyl benzene/M-1 (79/5/16) | core/shell = 50/50 |
| Lx-50 to Lx-54 | |
| core: n-dodecyl methacrylate homopolymer | |
| Lx-50 shell: styrene/M-1 (92/8) | core/shell = 50/50 |
| Lx-51 shell: styrene/M-1 (84/16) | core/shell = 50/50 |
| Lx-52 shell: ethyl acrylate/M-1 (96/4) | core/shell = 50/50 |
| Lx-53 shell: ethyl acrylate/M-1 (92/8) | core/shell = 50/50 |
| Lx-54 shell: styrene/methyl acrylate/M-3 (21/63/16) | core/shell = 50/50 |
| Lx-55 | |
| core: n-butyl acrylate homopolymer | |
| shell: styrene/M-2 (84/16) | core/shell = 50/50 |
| Lx-56, 67 | |
| core: ethylene glycol dimethacrylate/n-butyl acrylate copolymer (10/90) | |
| Lx-56 shell: styrene/M-1 (84/16) | core/shell = 50/50 |
| Lx-57 shell: methyl acrylate/M-5/methacrylic acid (65/15/20) | core/shell = 75/25 |
| Lx-58 to Lx-61 | |
| core: ethylene glycol dimethacrylate/n-butyl acrylate copolymer (20/80) | |
| Lx-58 shell: styrene/M-1 (84/16) | core/shell = 50/50 |

-continued

| | |
|---|---|
| Lx-59 shell: styrene/M-1 (84/16) | core/shell = 75/25 |
| Lx-60 shell: methyl acrylate/M-6/sodium 2-acrylamido-2-methylpropanesulfonate (80/15/5) | core/shell = 75/25 |
| Lx-61 shell: n-butyl acrylate/M-1 (84/16) | core/shell = 50/50 |
| Lx-62 to Lx-64 | |
| core: vinyl acetate homopolymer (100) | |
| Lx-62 shell: styrene/M-1 (84/16) | core/shell = 50/50 |
| Lx-63 shell: styrene/divinyl benzene/M-10 (79/5/16) | core/shell = 50/50 |
| Lx-64 shell: n-dodecyl methacrylate/butyl acrylate/M-5 (30/55/15) | core/shell = 40/60 |
| Lx-65 to Lx-67 | |
| core: divinyl benzene/2-ethylhexyl acrylate copolymer (10/90) | |
| Lx-65 shell: methyl acrylate/M-1 (84/16) | core/shell = 50/50 |
| Lx-66 shell: methyl acrylate/styrene/M-1 (74/10/16) | core/shell = 50/50 |
| Lx-67 shell: M-1 (100) | core/shell = 90/10 |
| Lx-68 to Lx-70 | |
| core: divinyl benzene/styrene/2-ethylhexyl acrylate copolymer (10/23/67) | |
| Lx-68 shell: methyl acrylate/M-1 (84/16) | core/shell = 50/50 |
| Lx-69 shell: methyl acrylate/styrene/M-1 (74/10/16) | core/shell = 50/50 |
| Lx-70 shell: ethyl acrylate/2-hydroxyethyl methacrylate/M-4 (65/15/20) | core/shell = 85/15 |
| Lx-71 | |
| core: ethylene glycol dimethacrylate/vinyl palmitate/n-butyl acrylate copolymer (20/20/60) | |
| shell: ethylene glycol dimethacrylate/styrene/ n-butyl methacrylate/M-1 (5/40/40/15) | core/shell = 50/50 |
| Lx-72 | |
| core: trivinyl cyclohexane/n-butyl acrylate/styrene copolymer (10/55/35) | |
| shell: methyl acrylate/M-1/sodium 2-acrylamido-2-methylpropanesulfonate (88/7/5) | core/shell = 70/30 |
| Lx-73, 74 | |
| core: divinyl benzene/styrene/methyl methacrylate copolymer (10/45/45) | |
| Lx-73 shell: n-butyl acrylate/M-1 (84/16) | core/shell = 50/50 |
| Lx-74 shell: n-dodecyl acrylate/ethyl acrylate/M-9 (60/30/10) | core/shell = 50/50 |
| Lx-75, 76 | |
| core: p-vinyltoluene/n-dodecyl methacrylate copolymer (70/30) | |
| Lx-75 shell: methyl acrylate/n-butyl methacrylate/ M-2/acrylic acid (30/55/10/5) | core/shell = 50/50 |
| Lx-76 shell: n-butyl acrylate/M-8 (84/16) | core/shell = 70/30 |

| | |
|---|---|
| M-1 | 2-acetoacetoxyethyl methacrylate |
| M-2 | 2-acetoacetoxyethyl acrylate |
| M-3 | 2-acetoacetoxypropyl methacrylate |
| M-4 | 2-acetoacetamidoethyl methacrylate |
| M-5 | 2-cyanoacetoxyethyl methacrylate |
| M-6 | 2-cyanoacetoxyethyl acrylate |
| M-7 | methylacryloyl acetoacetate |
| M-8 | N-(2-methacryloyloxymethyl)cyanoacetamide |
| M-9 | 4-acetoacetyl-1-methacryloylpiperadine |
| M-10 | p-(2-acetoacetoxy)ethylstyrene |

In the practice of the invention, the polymer latices may be used alone or in admixture of two or more.

In the photosensitive element of the invention, a hydrophilic colloid may be used. Gelatin is preferable although other hydrophilic colloids are also acceptable. Useful are gelatin derivatives, graft polymers of gelatin with other polymers, proteins such as albumin and casein; cellulose derivatives such as hydroxyethyl cellulose, carboxymethyl cellulose and cellulose sulfate ester; sucrose derivatives such as sodium alginate and starch derivatives; and various other synthetic hydrophilic polymers such as polyvinyl alcohol, polyvinyl alcohol partial acetal, poly-N-vinyl pyrrolidone, polyacrylic acid, polymethacrylic acid, polyacrylamide, polyvinylimidazole, and polyvinylpyrazole, in either homopolymer or copolymer form.

Examples of the gelatin used include lime treated gelatin, acid treated gelatin, and enzyme treated gelatin as described in Bull. Soc. Sci. Phot., Japan, No. 16, p. 30 (1966) as well as hydrolyzed and enzymatically decomposed products of gelatin. The use of low molecular weight gelatin as described in JP-A 158426/1989 is preferred for the preparation of tabular grains.

Preferably the hydrophilic colloid is coated in a coverage of 0.5 to 3 g, especially 1.0 to 2.2 g, per square meter of one surface of the photosensitive element.

In the preferred embodiment wherein the photographic silver halide photosensitive element contains the hydrophilic binder or hydrophilic colloid and the polymer latex, the invention favors that the polymer is used in an amount of at least 10% by weight of the binder, and that the photosensitive element has a swelling factor with water of up to 150%. Then the photosensitive element can be designed as a low drag-out one. The preferred swelling factor with water is from 30% to 150%, especially from 50% to 120%.

The proportion of the coverage of the polymer latex to the coverage of the hydrophilic binder, which is defined as (the coverage of polymer latex)/(the coverage of hydrophilic binder)×100% by weight, should be at least 10% by weight, preferably 25 to 400% by weight, more preferably 45 to 230% by weight, especially 50 to 150% by weight. This relationship applies to both the coverages on one side and the combined coverages on opposite sides of the photosensitive element.

In the preferred embodiment, the polymer latex is contained in the silver halide emulsion layer of the photographic silver halide photosensitive element although the polymer latex may be added to any other layers. The polymer latex may be added to the silver halide emulsion layer or one layer of other hydrophilic colloid layers, preferably both. Further preferably, the polymer latex is added to both the silver halide emulsion layer and the hydrophilic colloid layer disposed remotest from the support.

Where the polymer latex is added to both the emulsion layer and the protective layer, it is preferred that the weight ratio of the amount of polymer latex in the protective layer to the amount of polymer latex in the emulsion layer is in the range from 0.2 to 2.0.

In this embodiment, the amount of the polymer latex in the emulsion layer on one surface of the photosensitive element is preferably 0.9 to 2.0 g/m$^2$, more preferably 1.0 to 1.7 g/m$^2$. Similarly, the amount of gelatin on one surface of the photosensitive element is preferably 1 to 2.2 g/m$^2$, more preferably 1.2 to 2.0 g/m$^2$. The amount of gelatin and polymer latex combined on one surface of the photosensitive element is preferably 2.0 to 4.0 g/m$^2$, more preferably 2.5 to 3.5 g/m$^2$.

The swelling factor with water of the photosensitive element is defined as (the swollen thickness minus the dry thickness)/(the dry thickness)×100% when a dry film having a dry thickness is immersed in distilled water at 21° C. for 3 minutes whereupon the immersed film has a swollen thickness. The swelling factor is measured as follows. A photosensitive material sample is allowed to stand for 7 days at 40° C. and RH 60%. The sample is dipped in distilled water at 21° C. for 3 minutes and then frozen for fixation with liquefied nitrogen. Using a microtome, the same is sectioned perpendicular to its surface and freeze dried at −90° C. The sample treated as above is observed under a scanning electron microscope (SEM) to determine the thickness (Tw) of the swollen sample. The thickness (Td) of the dry sample is similarly determined in advance by a sectional observation under SEM. The swelling factor is calculated in accordance with (Tw−Td)/Td×100%.

The automatic processor serving as an image forming system includes a developing tank, a fixing tank, a plurality of wash tanks (including at least a first wash tank and a last wash tank), a drying zone, and feed means for conveying the photosensitive element from the developing tank to the fixing tank via rollers, then from the fixing tank to the first wash tank and then through the wash tanks, and finally from the last wash tank to the drying zone.

According to the invention, the drag-out of the developer by the photosensitive element is restricted to 1.0 ml or less and preferably, the drag-outs of the fixer and wash water are restricted to 1.0 ml or less.

The drag-out of the developer by the photosensitive element from the developing tank is the amount of the developer which is carried over from the developing tank to the fixing tank by the photosensitive element per quarter-size (10×12 inches) sheet. Differently stated, the dragout is the amount of the developer that the photosensitive element carries over after it passes past the roller located close to the fixing tank. The preferred drag-out is from 0.1 ml to 1.0 ml, especially from 0.2 ml to 0.8 ml. The drag-out can be regulated not only by a design of the photosensitive element, but also by the squeezing ability of the rollers of the processor. Careful squeezing is necessary because excessive squeezing can cause flaw on the photosensitive element and hence, defects on images.

Similarly, the drag-out of the fixer is defined as the amount of the fixer which is carried over from the fixing tank to the first wash tank by the photosensitive element per quarter-size (10×12 inches) sheet. The drag-out of wash water from the first wash tank is defined as the amount of wash water which is carried over from the first wash tank to the next wash tank by the photosensitive element per quarter-size (10×12 inches) sheet. The preferred drag-out of the fixer or wash water is from 0.1 ml to 1.0 ml, especially from 0.2 ml to 0.8 ml.

The drag-out of wash water from the last wash tank is defined as the amount of wash water which is carried over from the last wash tank to the drying zone by the photosensitive element per quarter-size (10×12 inches) sheet, and differently stated, the amount of water which is evaporated off to dryness in the drying zone per quartersize (10×12 inches) sheet. The preferred drag-out of the wash water is from 0.1 ml to 1.0 ml, especially from 0.2 ml to 0.8 ml. Although the multi-stage water washing is preferable, it is acceptable that the first wash tank is the last wash tank, and in this case, the drag-out of wash water from the last wash tank is important.

Emulsion

A variety of photosensitive silver halide emulsions may be used in the photographic silver halide photosensitive element according to the first and second embodiments of the invention. Preferred emulsions are emulsions of tabular silver chloride grains having {100} major faces, for example, the emulsions of Examples 3 and 4 in JP-A 204073/1993, the emulsion of Example 2ax in JP-A 194768/1994, and the emulsion of Example 1 in JP-A 227431/1994; emulsions of tabular silver chloride grains having {111} major faces, for example, tabular emulsion A of Example 1 in JP-A 76305/1996; and emulsions of tabular silver iodobromide and silver bromide grains with {111} major faces having a high aspect ratio and epitaxial sites, for example, tabular emulsion B of Example 1 in JP-A 76305/1996 and emulsions A to K of Examples in JP-A 69069/1996. Regular grains are also useful, and emulsions of monodisperse cubic grains such as emulsions E and F of Example 1 in JP-A 76305/1996 are preferably used.

These emulsions may have different halogen compositions from the above-described compositions such as AgBrClI, and such different halogen compositions are also preferable. With respect to monodispersity, tabular grains having a coefficient of variation of sphere equivalent diameter of 3% to 40% are preferred.

Tabular grains having a high silver chloride content are especially preferred for use in the emulsion of the invention.

In the silver halide emulsion containing at least silver halide grains and a dispersing medium, tabular silver halide grains presenting {100} or {111} faces as major surfaces and having an aspect ratio of at least 2 preferably account for at least 50%, more preferably 60 to 100%, most preferably 70 to 100% of the total projected area of silver halide grains. The term "tabular grain" used herein designates a grain having an aspect ratio (diameter/thickness) of at least 1, preferably at least 1.1. The major surfaces of a tabular grain are the largest outer surfaces thereof. The diameter is the diameter of a circle having an equal area to the projected area of a tabular grain, and the thickness is the distance between the two major surfaces. The thickness of tabular grains is up to 0.35 μm, preferably 0.05 to 0.3 μm, more preferably 0.05 to 0.25 μm. The aspect ratio of tabular grains is at least 2, preferably from 3 to 30, more preferably from 5 to 20. Accordingly, the average aspect ratio is preferably at least 2, more preferably from 3 to 30, most preferably from 5 to 20.

With respect to the halogen composition, an appropriate chloride ion ($Cl^-$) content is at least 20 mol %, preferably 30 to 100 mol %, more preferably 40 to 100 mol %, most preferably 50 to 100 mol %.

The tabular silver halide grains with {100} major surfaces which are preferred in the invention preferably have dislocation lines. An appropriate tabular grain has two dislocation lines extending from the nucleus based on screw dislocation. The screw dislocation can be ascertained by observing a sample for the disappearance of dislocation lines under a transmission electron microscope (TEM) while tilting the sample. It is generally known that if a dislocation line disappears when the direction of Burgers vector of dislocation (actual glide direction) and the direction of dislocation are parallel, that is, in a parallel relationship, it is screw dislocation. A {100} tabular grain has undergone anisotropic growth in two directions from the nucleus upon nucleation, that is, the directions in which two dislocation lines extend.

Of the emulsions used in the invention, the nucleation of an emulsion of grains presenting {111} faces as major surfaces is described, for example, in JP-B 8326/1989, 8325/1989, 8324/1989, JP-A 250943/1989, JP-B 14328/1991, 81782/1992, 40298/1993, 39459/1993, 12696/1993, JP-A 213836/1988, 218938/1988, 281149/1989, and 218959/1987. Tabular grains presenting {100} faces as major surfaces are described, for example, in JP-A 204073/1993, 88017/1976, 24238/1988, and Japanese Patent Application No. 264059/1993.

Using emulsions of tabular silver halide grains having a high silver chloride content, there are obtained photosensitive elements which are improved in development, fixation, residual color and water washing despite a low swelling factor.

For tabular grains having {100} major faces, any of the nucleation techniques described in the above-referred patents may be employed.

Described below is the technique of effecting crystal growth by physical ripening in the presence of silver halide fine grains (wherein the fine grains are dissolved and substrate grains grow).

In the fine-grain emulsion addition technique, an emulsion of AgX fine crystals having a diameter of up to 0.15 μm, preferably up to 0.1 μm, more preferably 0.06 to 0.006 μm is added whereby tabular grains grow by Ostwalt ripening. The fine-grain emulsion may be added continuously or successively. The fine-grain emulsion is continuously prepared by feeding a $AgNO_3$ solution and a $X^-$ salt solution into a mixer disposed in proximity to the reactor and immediately after preparation, it is continuously fed into the reactor. Alternatively, the fine-grain emulsion preformed batchwise in a separate vessel is continuously or successively fed to the reactor. The fine-grain emulsion may be added in liquid or dry powder form. The dry powder may be mixed with water whereby it is added in liquid form. The fine grains are preferably added in such a manner that they will disappear within 20 minutes, more preferably within 10 seconds to 10 minutes. A longer disappearance time is undesirable because fine grains can undergo ripening to increase their size. Therefore, it is recommended not to add the fine-grain emulsion all at once. Also preferably, the fine grains are substantially free of multiple twin grains. The multiple twin grain designates a grain having two or more twin faces. The term "substantially free" means that the proportion of multiple twin grains is up to 5%, preferably up to 1%, more preferably up to 0.1% by number. Further preferably, the fine grains are substantially free of singlet twin grains. Further preferably, the fine grains are substantially free of screw dislocation. The term "substantially free" is used in the same meaning as above.

The fine grains have a halogen composition of AgCl, AgBr, AgBrI (the $I^-$ content is preferably up to 10 mol %, more preferably up to 5 mol %) and a mixture of two or more. In this regard, reference is made to Japanese Patent Application No. 214109/1992.

The total amount of fine grains added should be at least 20% by weight, preferably at least 40% by weight, more preferably 50 to 98% by weight of the entire amount of silver halide. The Cl content of fine grains is preferably at least 10 mol %, more preferably 50 to 100 mol %.

The dispersing medium used during nucleation, ripening and growth may be any of well-known dispersing media for AgX emulsion. It is preferred to use gelatin having a methionine content of 0 to 100 μmol/g, more preferably 0 to 50 μmol/g. When such gelatin is used during ripening and growth, thinner tabular grains having a narrow diameter size distribution are advantageously formed. Other preferred dispersing media are synthetic polymers as described in JP-B 16365/1977, Journal of Japanese Photographic Society, vol. 29 (1), 17, 22 (1966), ibid., vol. 30 (1), 10, 19 (1967), ibid., vol. 30 (2), 17 (1967), and ibid., vol. 33 (3), 24 (1967).

After fine grains are added, growth is preferably effected at pH 2.0 or higher, preferably pH 3 to 10, more preferably pH 4 to 9. Also, growth is preferably effected at pCl 1.0 or higher, preferably 1.3 or higher, more preferably 1.5 to 3.0. It is noted that pCl is defined as $$pCl=-\log[Cl^-]$$

wherein $[Cl^-]$ is the activity of Cl ion in the solution. Reference should be made to T. H. James, The Theory of The Photographic Process, 4th Ed., Ch. 1. These growth conditions are preferred especially for tabular grains having {100} major faces.

If the pH is lower than 2.0, in the case of tabular grains having {100} major faces, for example, the lateral growth may be restrained to lower the aspect ratio, and the emulsion tends to lower the covering power and sensitivity. Above pH 2.0, the lateral growth rate may become higher, and an emulsion having a high aspect ratio and covering power is obtained although the emulsion tends to have high fog and low sensitivity.

If the pCl is lower than 1.0, the vertical growth may be promoted to lower the aspect ratio, and the emulsion tends to lower the covering power and sensitivity. If the pCl exceeds 1.6, the aspect ratio becomes higher and the covering power increases although the emulsion tends to have high fog and low sensitivity. If silver halide fine grains help substrate grains grow at this point, there result low fog, high sensitivity, high aspect ratio and high covering power even above pH 6 and/or pCl 1.6.

With respect to the monodispersity of the emulsion according to the invention, the monodispersity is preferably less than 30%, more preferably 5 to 25% when expressed by a coefficient of variation as defined by the method described in JP-A 745481/1984. Especially when the emulsion is used in high contrast photosensitive element, a coefficient of variation of 5 to 15% is preferred.

In the photosensitive element of the invention, a matte agent may be used. The matte agent is preferably selected from matte agent Nos. 1 to 8 described in Example 1 of JP-A 194779/1994 and Compounds 1 to 9 described in JP-A 138572/1994, paragraph [0023]. The size and amount of the matte agent are described in JP-A 194779/1994, paragraph [0049]. A mixture of two or more matte agents having different particle sizes is also useful. With respect to the particle size distribution of the matte agent, either monodisperse particles having a coefficient of variation of particle size of 3 to 30% or polydisperse particles having a coefficient of variation of particle size of more than 30% may be used.

Developer

The developer used in the method of the invention contains an ascorbic acid compound as a developing agent. The term "ascorbic acid compound" is used herein as including ascorbic acid and derivatives thereof. The ascorbic acid compound is preferably of the following general formula (I).

(I)

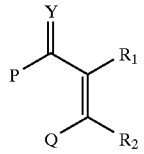

In formula (I), $R^1$ and $R_2$ are independently hydroxyl groups; amino groups which may have a substituent, for example, alkyl having 1 to 10 carbon atoms such as methyl, ethyl, n-butyl and hydroxyethyl or which may form a salt; acylamino groups such as acetylamino and benzoylamino; alkylsulfonylamino groups such as methanesulfonylamino; arylsulfonylamino groups such as benzenesulfonylamino and p-toluenesulfonylamino; alkoxycarbonylamino groups such as methoxycarbonylamino; mercapto groups; or alkylthio groups such as methylthio and ethylthio. Preferred groups represented by $R_1$ and $R_2$ are hydroxyl, amino, alkylsulfonylamino, and arylsulfonylamino groups.

P and Q are independently hydroxyl groups, carboxyl groups, substituted or unsubstituted alkoxy groups, substituted or unsubstituted alkyl groups, sulfo groups, substituted or unsubstituted amino groups, or substituted or unsubstituted aryl groups. Alternatively, P and Q are groups of atoms which, taken together, form a 5- to 8-membered ring with the two vinyl carbon atoms having $R_1$ and $R_2$ substituents and the carbon atom having Y substituent. Exemplary ring structures are constructed by combining —O—, —C($R_9$)($R_{10}$)—, —C($R_{11}$)=, —C(=O)—, —N($R_{12}$)—, and —N=. Each of $R_9$, $R_{10}$, $R_{11}$, and $R_{12}$ is a hydrogen atom, substituted or unsubstituted alkyl group having 1 to 10 carbon atoms (exemplary substituents being hydroxy, carboxy, and sulfo groups), hydroxyl group, or carboxyl group. $R_9$ to $R_{12}$ may constitute a saturated or unsaturated ring fused to the 5 or 8-membered ring.

Examples of the 5 or 8-membered ring include dihydrofuranone ring, dihydropyrone ring, pyranone ring, cyclopentenone ring, cyclohexenone ring, pyrolynone ring, pyrazolinone ring, pyridone ring, azacyclohexenone ring, and uracil ring, with the dihydrofuranone, cyclopentenone, cyclohexenone, pyrazolinone, azacyclohexenone, and uracil rings being preferred.

Y is =O or =N=$R_3$ wherein $R_3$ is selected from hydrogen atoms, hydroxyl groups, alkyl groups such as methyl and ethyl, acyl groups such as acetyl, hydroxyalkyl groups such as hydroxymethyl and hydroxyethyl, sulfoalkyl groups such as sulfomethyl and sulfoethyl, and carboxyalkyl groups such as carboxymethyl and carboxyethyl.

Several illustrative examples of the ascorbic acid compound of formula (I) are given below although the invention is not limited thereto.

A-1

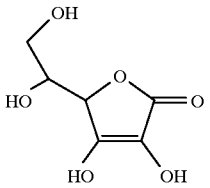

A-2

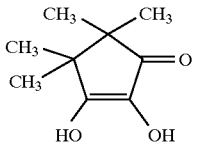

A-3

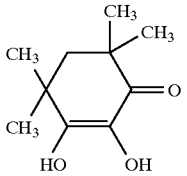

A-4

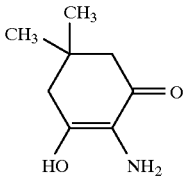

-continued

A-5

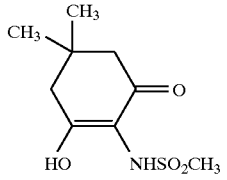

A-6

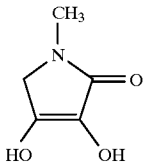

A-7

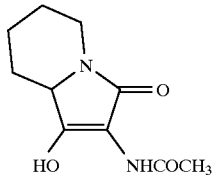

A-8

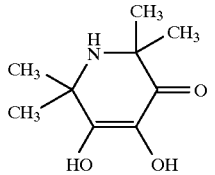

A-9

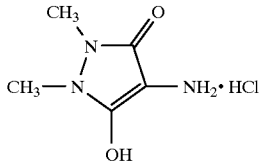

A-10

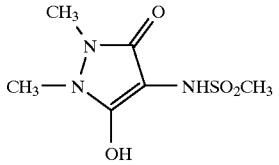

A-11

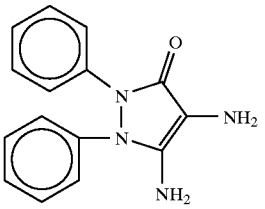

-continued

A-12

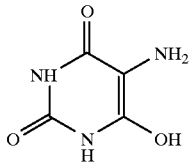

A-13

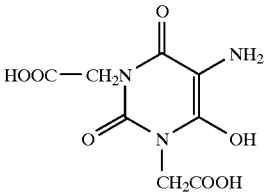

A-14

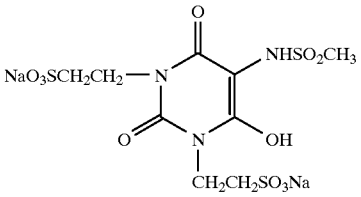

A-15

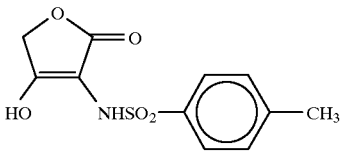

A-16

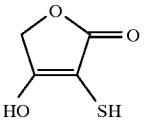

A-17

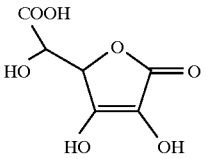

A-18

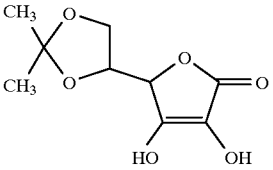

A-19

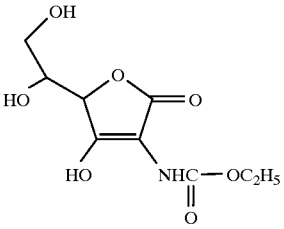

-continued

A-20

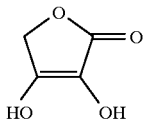

A-21

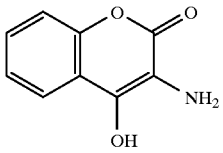

A-22

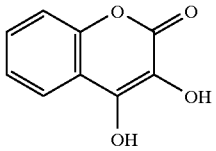

A-23

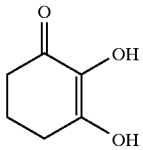

A-24

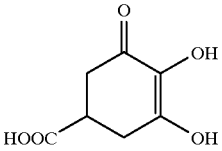

Among the ascorbic acid compounds used in the developer according to the invention, preferred are ascorbic acid, erythorbic acid which is a diastereomer of ascorbic acid, and alkali metal salts thereof such as lithium, sodium and potassium salts.

The ascorbic acid compounds are preferably used in the developer as a developing agent in amounts of 0.01 to 0.8 mol/liter, more preferably 0.1 to 0.4 mol/liter.

Along with the developing agent of formula (I), an auxiliary developing agent having superadditivity is preferably used in the developer. The auxiliary developing agents having superadditivity include 1-phenyl-3-pyrazolidone and p-aminophenol derivatives.

Non-limiting examples of the 1-phenyl-3-pyrazolidone auxiliary developing agent used herein include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, and 1-p-tolyl-4-methyl-4-hydroxymethyl-3-pyrazolidone, with the 1-phenyl-4-methyl-4-hydroxymethyl-3-pyrazolidone being preferred.

Examples of the p-aminophenol auxiliary developing agent used herein include N-methyl-p-aminophenol, N-(β-hydroxyethyl)-p-aminophenol, N-(4-hydroxyphenyl) glycine, 2-methyl-p-aminophenol, and p-benzylaminophenol, with the N-methyl-p-aminophenol being preferred.

When the developing agent of formula (I) is used in combination with a 1-phenyl-3-pyrazolidone or p-aminophenol auxiliary developing agent, it is preferred to use the former in an amount of 0.01 to 0.5 mol/liter and the latter in an amount of 0.001 to 0.1 mol/liter. It is more preferred to use the latter in an amount of 0.005 to 0.05 mol/liter.

The developer used herein is substantially free of polyhydroxybenzene compounds as typified by dihydroxybenzene or hydroquinone. The term "substantially free" means that the content of polyhydroxybenzene compound is 0.0001 mmol/liter or less, most preferably the content is zero.

For accelerating development, the developer used herein may further contain amino compounds, for example, those disclosed in JP-A 106244/1981, 267759/1986 and 208652/1990.

The developer is preferably at pH 8.0 to 13.0, more preferably pH 8.3 to 12, most preferably pH 8.5 to 10.5.

An alkaline agent is used in the developer for pH adjustment. The alkaline agents are usually water-soluble inorganic alkali metal salts such as sodium hydroxide and sodium carbonate. In the developer of the invention, there may be added pH buffers such as disodium phosphate, dipotassium phosphate, monosodium phosphate, and monopotassium phosphate as well as pH buffers as disclosed in JP-A 93433/1985. The amount of the alkaline agent or pH buffer used for pH adjustment is preferably at least 0.3 mol/liter, more preferably 0.4 to 1 mol/liter.

Boron compounds such as boric acid and sodium metaborate are often used in conventional developers as a pH buffer. They are not preferred in the developer of the invention containing an ascorbic acid compound as the developing agent because they can react with the ascorbic acid compound to deactivate it.

An anti-silver-sludging agent may be contained in the developer of the invention. Use may be made of the compounds described in JP-B 4702/1987, 4703/1987, JP-A 200249/1989, 303179/1993, and 53257/1993.

In addition to the amino compound, alkaline agent and anti-sludging agent described above, the developer used herein may further contain development retarders such as potassium bromide and potassium iodide, organic solvents such as dimethylformamide, methyl cellosolve, ethylene glycol, ethanol and methanol, and antifoggants such as 5-methylbenztriazole, 5-chlorobenztriazole, 5-bromobenztriazole, 5-butylbenztriazole, and benztriazole.

Sulfites may be used in the developer as a preservative. Examples of the sulfite preservative include sodium sulfite, potassium sulfite, lithium sulfite, ammonium sulfite, sodium bisulfite, and potassium metabisulfite. The sulfite is preferably used in an amount of about 0.01 to 2.5 mol/liter, more preferably about 0.02 to 2 mol/liter.

Since the photosensitive element has a high content of polymer latex for providing a high hardening feature, an emulsion of silver chloride-rich tabular grains is preferably used to ensure high sensitivity upon development and effective desilvering upon fixation. When such an emulsion is used, more silver ions are dissolved out in the low replenishment process which is favored by the invention. It is then desired to design the developer so as to reduce the amount of sulfite ion which has a dissolving power to the silver halide. This, in turn, retards the decolorization in the developer of the dye for crossover light cutting so that the developer may be colored. If the colored developer is excessively carried over to the fixer, it causes coloring and dye deposition rather than decolorization. It is thus desired to minimize the drag-out. The invention is based on this conception.

Also useful are those compounds described in L. F. A. Mason, "Photographic Processing Chemistry," Focal Press (1966), pp. 226–229, U.S. Pat. Nos. 2,193,015 and 2,592,364, and JP-A 64933/1973.

If desired, toners, surfactants, water softeners, hardening agents and other addenda are contained in the developer.

Chelating agents which can be contained in the developer include ethylenediamine diorthohydroxyphenylacetic acid, diaminopropane tetraacetic acid, nitrilotriacetic acid, hydroxyethyl ethylenediamine triacetic acid, dihydroxyethyl glycine, ethylenediamine diacetic acid, ethylenediamine dipropionic acid, iminodiacetic acid, diethylenetriamine pentaacetic acid, hydroxyethyliminodiacetic acid, 1,3-diaminopropanol tetraacetic acid, triethylenetetramine hexaacetic acid, transcyclohexanediamine tetraacetic acid, ethylenediamine tetraacetic acid, glycol ether diamine tetraacetic acid, ethylenediaminetetrakismethylenephosphonic acid, diethylenetriaminepentamethylenephosphonic acid, nitrilotrimethylenephosphonic acid, 1-hydroxyethylidene-1,1-diphosphonic acid, 1,1-diphosphonoethane-2-carboxylic acid, 2-phosphonobutane-1,2,4-tricarboxylic acid, 1-hydroxy-1-phosphonopropane-1,3,3-tricarboxylic acid, catechol-3,4-disulfonic acid, sodium pyrophosphate, sodium tetrapolyphosphate, and sodium hexametaphosphate. Especially preferred are diethylenetriamine pentaacetic acid, triethylenetetramine hexaacetic acid, 1,3-diaminopropanol tetraacetic acid, glycol ether diamine tetraacetic acid, hydroxyethyl ethylenediamine triacetic acid, 2-phosphonobutane-1,2,4-tricarboxylic acid, 1,1-diphosphonoethane-2-carboxylic acid, nitrilotrimethylenephosphonic acid, ethylenediaminetetrakismethylenephosphonic acid, diethylenetriaminepentaphosphonic acid, 1-hydroxypropylidene-1,1-diphosphonic acid, 1-aminoethylidene-1,1-diphosphonic acid, and 1-hydroxyethylidene-1,1-diphosphonic acid and salts thereof.

Of all the cations contained in the developer according to the invention, it is preferred that a potassium ion accounts for 10 to 90 mol % and a sodium ion accounts for 10 to 90 mol %. More preferably, a potassium ion accounts for 20 to 50 mol % and a sodium ion accounts for 50 to 80 mol %.

The developer of the invention can take the form of a concentrate for the purpose of reducing the cost of transportation and the space for storage. The concentrate should preferably have a concentration factor of 3 or less, more preferably 2 or less, for the purpose of preventing developer components from precipitating at low temperatures. For storage, components having different solubilities may be divided into several parts which are to be mixed and diluted on use. Most preferably, the developer of the invention is in the form of a one-part twice concentrated liquid.

With respect to the replenishment of the developer according to the invention, a dilute developer is preferably replenished in an amount of 200 to 25 ml, more preferably 180 to 30 ml, further preferably 150 to 60 ml per square meter of the photosensitive element.

In the development step according to the invention, the preferred developing conditions include a temperature of 20° C. to 50° C. and a time of 5 to 60 seconds, more preferably 25 to 40° C. and 5 to 45 seconds, most preferably 32 to 38° C. and 6 to 15 seconds.

Fixer

Next, the fixer used in the practice of the invention is described.

The fixer used herein is preferably an aqueous solution containing a thiosulfate as a fixing agent. Exemplary thiosulfates are sodium thiosulfate (hypo) and ammonium thiosulfate. The thiosulfate may be used in any suitable amount although it is generally used in amounts of about 0.1 to 2.0 mol/liter, preferably 0.3 to 1.8 mol/liter.

If desired, the fixer contains preservatives (e.g., sulfites and bisulfites), pH buffers (e.g., acetic acid and boric acid), pH adjusting agents (e.g., ammonia and sulfuric acid), chelating agents, surfactants (e.g., anionic surfactants such as sulfonates, polyethylene surfactants, and ampholytic surfactants as described in JP-A 6804/1982), humectants (e.g., alkanolamines and alkylene glycols), fixation promoters (e.g., thiourea derivatives as described in JP-B 35754/1970, 122535/1983, and 122536/1983, alcohols having a triple bond in a molecule, thioether compounds as described in U.S. Pat. No. 4,126,459, and mesoionic compounds as described in JP-A 143755/1992, 143756/1992, 143757/1992 and 170539/1992).

In the fixer according to the invention, however, tartaric acid, citric acid, gluconic acid, succinic acid and derivatives thereof, alone or in admixture of two or more, are preferred as the pH buffer to the above-described acetic acid and boric acid. If acetic acid is used instead as the pH buffer agent, it will give rise to a problem of odor and cause substantial rusting of metallic parts. The amount of acetic acid must be increased in order to achieve equivalent results to succinic acid, which gives conditions under which metallic parts are more likely to rust.

In the preferred embodiment described above, the fixer contains at least 0.15 mol/liter, especially 0.15 to 0.50 mol/liter of succinic acid. This fixer ensures that the photosensitive element is effectively dried, eliminates odor, and causes no rusting of metallic parts in the processor.

The fixer is at pH 3 or higher, preferably pH 4.5 to 6.3 and more preferably pH 5.0 to 6.3.

In the fixation step according to the invention, the preferred fixing conditions include a temperature of 20° C. to 50° C. and a time of 3 seconds to 1 minute, more preferably 25 to 40° C. and 5 to 40 seconds.

Preferably the fixer according to the invention is substantially free of an aluminum ion. The term "substantially free" means that the content of aluminum ion is 1 mmol/liter or less The fixer of the invention can take the form of a concentrate for the purpose of reducing the cost of transportation and the space for storage. The concentrate should preferably have a concentration factor of 5 or less, more preferably 3 or less, for the purpose of preventing fixer components from precipitating at low temperatures. For storage, components having different solubilities may be divided into several parts which are to be mixed and diluted on use. Most preferably, the fixer of the invention is in the form of a one-part twice concentrated liquid.

With respect to the replenishment of the fixer of the invention, a dilute fixer is preferably replenished in an amount of up to 250 ml, more preferably 200 to 10 ml, further preferably 180 to 20 ml, most preferably 150 to 25 ml per square meter of the photosensitive element.

The replenishing amount of the fixer is restricted to the above-defined range for the following reason. If the replenishing amount is too small, not only the silver halide in the photosensitive element is dissolved out into the fixer to gradually increase its concentration, but also sensitizing dyes and other components in the photosensitive element accumulate in the fixer to an excessive level, becoming a cause of staining. If the replenishment amount of the fixer is too large, the amount of spent fixer having a high chemical oxygen demand (COD) and high biological oxygen demand (BOD) increases, which is ecologically undesirable and requires an increased cost for the disposal of spent solution.

Not only succinic acid, but also salts of succinic acid are effective in the practice of the invention. Preferred salts are alkali metal salts such as lithium, sodium and potassium salts and ammonium salt.

The fixer used herein is preferably an aqueous solution containing a thiosulfate as a fixing agent, at pH 4.2 or higher, preferably pH 4.8 to 6.2. Exemplary thiosulfates are sodium thiosulfate (hypo) and ammonium thiosulfate. The thiosulfate may be used in any suitable amount although it is generally used in amounts of about 0.3 to 1.5 mol/liter.

In the fixer, sulfites inclusive of bisulfites are contained as the preservative in an amount of 0.01 to 0.30 mol/liter. Examples of the sulfite include sodium sulfite, potassium sulfite, lithium sulfite, ammonium sulfite, sodium bisulfite, and potassium metabisulfite.

In the fixer, there may be contained water-soluble aluminum salts serving as the film hardener, for example, aluminum chloride, aluminum sulfate, and potassium alum. When used, the water-soluble aluminum salt is usually added in an amount of 0.01 to 0.15 mol/liter.

In the fixer, tartaric acid, citric acid, gluconic acid and derivatives thereof may be used alone or in admixture of two or more. These compounds are preferably contained in the fixer in an amount of at least 0.005 mol/liter, more preferably 0.01 to 0.03 mol/liter. These compounds do not have the function to take the place of succinic acid because they serve to stabilize aluminum and it is impossible to add a large amount of these compounds as previously described.

The fixer used in the processing of the photosensitive element according to the invention should preferably be substantially free of acetic acid or salts thereof. Differently stated, the content of acetic acid in the fixer should preferably be less than 0.10 mol/liter, more preferably 0 to 0.05 mol/liter.

In the fixer, boric acid may be used as the pH buffer, and sodium hydroxide and sulfuric acid may be used as the pH regulator. Also, chelating agents having an ability to soften hard water and the compounds described in JP-A 78551/1987 may be contained.

It is understood that the contents and replenishment amounts described above are based on a ready-to-use solution.

In one embodiment of the invention wherein the developer and the fixer are a developer concentrate and a fixer concentrate, respectively, the concentrates are diluted for use as a replenisher or tank solution. One dilution mode is by previously diluting developer and fixer concentrates and charging developing and fixing tanks with a dilute developer and a dilute fixer, respectively. In a more preferred mode (known as direct mixing dilution mode), a developer concentrate and a fixer concentrate are diluted with water in respective tanks to form ready-to-use solutions which are supplied as the replenisher.

Where the automatic processor includes cartridges containing a developer stock and a fixer stock and chemical mixers, they are preferably designed such that the cartridges may be emptied of the developer and fixer stocks at the same time.

According to the processing method of the invention, the photosensitive element which has been developed and fixed is treated with washing water or stabilizing solution and then dried.

Washing water is preferably passed through a filter member or filter layer of activated carbon for removing foreign matter and organic matter before it is supplied into the washing tank.

Where washing is performed with a small amount of water, it is preferred to provide the processor with a squeeze roller washing tank as described in JP-A 18350/1988. A water washing arrangement as described in JP-A 143548/1988 is also preferred. When water is replenished to a washing or stabilizing bath through antibacterial means, a part or the entirety of water overflowing from the washing or stabilizing bath can be utilized in a preceding step to form a part of a processing solution having a fixing function as described in JP-A 235133/1985. Known means for reducing the replenishment amount of washing water is a multi-stage counterflow system (typically two or three stages). The multi-stage counterflow system ensures more efficient water washing because the photosensitive element after fixation is gradually processed in a cleaner direction. For such water saving or pipeless treatment, anti-bacterial means is preferably applied to washing water or stabilizer solution.

The known anti-bacterial means includes irradiation of ultraviolet radiation as disclosed in JP-A 263939/1985; application of a magnetic field as disclosed in JP-A 263940/1985; the use of ion-exchange resins to purify water as disclosed in JP-A 131632/1986; blowing of ozone and circulation through a filter and adsorbent column as described in JP-A 151143/1992; bacterial decomposition as described in JP-A 240636/1992; and anti-bacterial agents as disclosed in JP-A 115154/1987, 153952/1987, 220951/1987 and 209532/1987. Also useful are anti-fungal agents, anti-bacterial agents and surfactants as described in M. W. Beach, "Microbiological Growths in Motion-Picture Processing", SMPTE Journal, Vol. 85 (1976); R. O. Deegan, "Photo Processing Wash Water Biocides", J. Imaging Tech., 10, No. 6 (1984); and JP-A 8542/1982, 58143/1982, 97530/1982, 132146/1982, 257244/1982, 18631/1983, and 105145/1983.

In the washing or stabilizing bath, there may be optionally added as a microbiocide the isothiazolines described in R. T. Kreiman, J. Image Tech., 10 (6), 242 (1984), bromochlorodimethylhydantoin, the isothiazolines described in Research Disclosure, Vol. 205, No. 20526 (May 1981) and Vol. 228, No. 22845 (April 1983), and the compounds described in JP-A 209532/1987. Other useful compounds are described in HORIGUCHI Hiroshi, "Bokin Bobai no Kagaku (Antibacterial and Antifungal Chemistry)", Sankyo Publishing K.K., 1982, and Nippon Bokin Bobai Society, "Bokin Bobai Gijutu Handbook (Antibacterial & Antifungal Engineering Handbook)", Hakuhodo K. K., 1986.

In the processor used herein, the washing tank is preferably provided at an outlet port with an electromagnetic valve as anti-slime means.

Washing in the water or stabilizer bath is preferably carried out at a temperature of 15 to 40° C. for about 0 to 1 minute. The preferred replenishment amount of washing water is 65 to 3000 ml/m$^2$ of the photosensitive element.

After development, fixation, and water washing (or stabilization), the photosensitive element is passed between squeeze rollers for squeezing off washing water and then dried. Drying is done at a temperature of about 40 to 100° C. The drying time is variable depending on various conditions although a time of about 5 seconds to about 3 minutes is commonly used. Drying is preferably done at 40 to 80° C. for about 5 seconds to about 2 minutes. Heat rollers are preferably used for drying.

In the photosensitive element processing system according to the invention, the dry-to-dry processing time is preferably about 10 to 210 seconds, more preferably about 15 to 80 seconds, and most preferably about 20 to 65 seconds. The "dry-to-dry processing time" is an overall processing time passed from the entry of the photosensitive element into the developing tank to the end of drying.

The automatic processor used herein may be of the roller conveyor or belt conveyor system. An automatic processor of the roller conveyor type is preferred. An automatic processor including a developing tank having a reduced aperture (which is an area of the surface of the developing solution in contact with air in the developing tank per tank volume) of up to 0.04 cm$^{-1}$, more preferably up to 0.03 cm$^{-1}$, most preferably up to 0.025 cm$^{-1}$ as disclosed in JP-A 193853/1989 is especially preferred because air oxidation and evaporation are minimized, and the replenishment amount is reduced.

In order that the photosensitive element processing system according to the invention accomplish processing within a dry-to-dry processing time of 200 seconds, various modifications are made to the process for avoiding development variations inherent to the rapid processing. Exemplary modifications include the use of rubbery material rollers in the developing tank as outlet rollers to prevent uneven development inherent to rapid processing as described in JP-A 151944/1988; a developer jet flow in the developing tank at a flow speed of at least 10 m/min. for agitating the developer therein as described in JP-A 151943/1988; and more rigorous agitation during development than in standby periods as described in JP-A 264758/1988. Further for the rapid processing, the fixing tank is provided with an arrangement of opposed rollers for increasing the fixation rate. The opposed roller arrangement is effective for reducing the number of rollers and the size of the fixing tank, that is, making the processor more compact.

Preferably the processor is removably loaded with flexible containers which are filled with the replenishers. The containers are preferably formed of flexible materials, typically in film form, having an oxygen permeability of up to 50 ml/m$^2$·atm·day (temperature 20° C. and relative humidity 60%). The containers may have a gage of 1 mm or more although they preferably have a gage of up to 500 $\mu$m, more preferably up to 250 $\mu$m, most preferably 70 to 150 $\mu$m. The flexible material used herein is defined as follows. A film strip of 20 cm long and 2 cm wide is rested on a horizontal desk. The film strip is longitudinally moved so that it projects 10 cm from one end of the horizontal desk and its free end sags. When the sagging free end of the film strip is apart from the horizontal plane of the desk by a vertical distance of at least 2 cm, preferably at least 3 cm, more preferably at least 5 cm, this film is regarded flexible.

Examples of the flexible, easy-to-handle material having an oxygen permeability of up to 50 ml/m$^2$·atm·day (temperature 20° C. and relative humidity 60%) include cellophane, polyethylene, polyesters, polyvinyl chloride, polyvinylidene chloride, polypropylene, nylon, aluminum foil-laminated films, metallized films (typically aluminized films), and silica-evaporated films. Among these, plastic materials containing at least one of saponified ethylenevinyl acetate copolymers and nylon and having an oxygen permeability of up to 50 ml/m$^2$·atm·day, especially up to 25 ml/m$^2$·atm·day (temperature 20° C. and relative humidity 60%) are preferable because they are readily formed into containers having a sufficient strength.

When the developer and the fixer are stored in containers of such plastic material, they maintain their photographic properties stable during long-term storage.

The measurement of oxygen permeability is carried out by the method described in N. J. Calvano et al., "$O_2$ permeation of plastic container," Modern Packing, December 1986, pages 143–145.

Replenisher containers may be formed solely of a plastic material containing at least one of saponified ethylene-vinyl acetate copolymers (commercially available as EVAL®) and nylon and having an oxygen permeability of up to 50 ml/m$^2$·atm·day (temperature 20° C. and relative humidity 60%). Alternatively, two or more films of different plastic materials are laminated to a support to form a composite film, of which replenisher containers are formed.

These plastic packaging materials may be configured into containers of any desired shape including containers of cubic type and containers of overlap pillow type. Containers of the pillow type are preferable because they can be collapsed to a substantially zero volume after they are emptied of the replenisher contents.

Various methods and addenda which can be used in the photographic photosensitive elements according to the invention are shown below by referring to the teaching patent references.

1) Silver halide emulsion and its preparation

JP-A 68539/1990, page 8, lower-right column, line 15 to page 10, upper-right column, line 12; JP-A 24537/1991, page 2, lower-right column, line 10 to page 6, upper-right column, line 1 and page 10, upper-left column, line 16 to page 11, lower-left column, line 19; and JP-A 107442/1992

2) Chemical sensitizing method

JP-A 68539/1990, page 10, upper-right column, line 13 to upper-left column, line 16 and JP-A 313282/1993

3) Antifoggant & stabilizer

JP-A 68539/1990, page 10, lower-left column, line 17 to page 11, upper-left column, line 7 and page 3, lower-left column, line 2 to page 4, lower-left column 4) Tone modifier JP-A 276539/1987, page 2, lower-left column, line 7 to page 10, lower-left column, line 20 and JP-A 94249/1991, page 6, lower-left column, line 15 to page 11, upper-right column, line 19

5) Spectral sensitizing dye

JP-A 68539/1990, page 4, lower-right column, line 4 to page 8, lower-right column 6) Surfactant & antistatic agent JP-A 68539/1990, page 11, upper-left column, line 14 to page 12, upper-left column, line 9

7) Matting agent, lubricating agent & plasticizer

JP-A 68539/1990, page 12, upper-left column, line 10 to upper-right column, line 10 and page 14, lower-left column, line 10 to lower-right column, line 1

8) Hydrophilic colloid

JP-A 68539/1990, page 12, upper-right column, line 11 to lower-left column, line 16

9) Hardener

JP-A 68539/1990, page 12, lower-left column, line 17 to page 13, upper-right column, line 6

10) Support

JP-A 68539/1990, page 13, upper-right column, line 7–20

11) Crossover cutting

JP-A 264944/1990, page 4, upper-right column, line 20 to page 14, upper-right column 12) Dye & mordant JP-A 68539/1990, page 13, lower-left column, line 1 to page 14, lower-left column, line 9; and JP-A 24537/1991, page 14, lower-left column to page 16, lower-right column 13) Polyhydroxybenzene JP-A 39948/1991, page 11, upper-left column to page 12, lower-left column and EP 452772 A 14) Layer arrangement

JP-A 198041/1991

15) Processing

JP-A 103037/1990, page 16, upper-right column, line 7 to page 19, lower-left column, line 15; and JP-A 115837/1990, page 3, lower-right column, line 5 to page 6, upper-right column, line 10

The present invention is applicable to a variety of photosensitive elements including black-and-white photographic silver halide photosensitive elements such as graphic printing photosensitive elements, microfilm photosensitive elements, medical radiographic photosensitive elements, industrial radiographic photosensitive elements, general-purpose negative photosensitive elements, and general-purpose reversal photosensitive elements; general-purpose color negative photosensitive elements, general-purpose color reversal photosensitive elements, and color paper photosensitive elements. Most preferably, the invention is applied to medical radiographic photosensitive elements and imaging systems using the same.

EXAMPLE

Examples of the invention are given below by way of illustration and not by way of limitation. Note that tabular grains having {100} major faces are simply referred to {100} tabular grains. Mw is a weight average molecular weight.

Example 1

Emulsion A: high silver chloride {100} tabular grains

A reactor was charged with 1,582 ml of an aqueous gelatin solution (containing 19.5 g of gelatin-1 (deionized, alkali-treated bone gelatin having a methionine content of about 40 μmol/g) and 7.8 ml of a 1N $HNO_3$ solution, pH 4.3) and 13 ml of a NaCl-1 solution (containing 10 g of NaCl in 100 ml of water). With the temperature kept at 40° C., 15.6 ml of an Ag-1 solution (containing 20 g of $AgNO_3$ in 100 ml of water) and 15.6 ml of a X-1 solution (containing 7.05 g of NaCl in 100 ml of water) were concurrently added to the reactor at a rate of 62.4 ml/min and mixed therein. After 3 minutes of agitation, 28.2 ml of an Ag-2 solution (containing 2 g of $AgNO_3$ in 100 ml of water) and 28.2 ml of a X-2 solution (containing 1.4 g of KBr in 100 ml of water) were concurrently added to the reactor at a rate of 80.6 ml/min and mixed therein. After 3 minutes of agitation, 46.8 ml of the Ag-1 solution and 46.8 ml of the X-1 solution were concurrently added to the reactor at a rate of 62.4 ml/min and mixed therein. After 2 minutes of agitation, 203 ml of an aqueous gelatin solution (containing 13 g of gelatin-1, 1.3 g of NaCl, and an amount of 1N NaOH solution to adjust to pH 6.5) was added to the solution to give pCl 1.75. Thereafter, the temperature was raised to 63° C., a hydrogen peroxide solution was added in an amount of $6\times10^{-4}$ mol/g of the gelatin to adjust to pCl 1.70, and the solution was ripened for 3 minutes. Thereafter, a AgCl fine grain emulsion (E-1) (mean particle diameter 0.1 μm) was added over 20 minutes at a rate of $2.68\times10^{-2}$ mol/min of AgCl. After the completion of addition, the solution was ripened for 40 minutes. Flocculant-1 (shown below) was added to the solution, which was cooled to a temperature of 35° C. to cause grains to sediment. After water washing, an aqueous alkali-treated gelatin solution was added to the grains and the emulsion was adjusted to pH 6.0 at 60° C. A TEM image of a replica of the grains was observed. The resultant emulsion was found to be an emulsion of silver chlorobromide {100} tabular grains containing 0.44 mol % based on silver of AgBr.

Flocculant-1

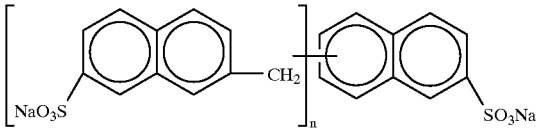

n = 2 ≈ 9

The configurational characteristics of the grains were:

(the total projected area of {100} tabular grains having an aspect ratio of from 2 to 30)/(the sum of projected areas of entire silver halide grains)×100=a1=95%, an average aspect ratio (average diameter/average thickness) of {100} tabular grains having an aspect ratio of from 2 to 30=a2=15.5, an average projected area diameter of {100} tabular grains having an aspect ratio of from 2 to 30=a3=1.40 μm, an average adjacent major face edge ratio of {100} tabular grains having an aspect ratio of from 2 to 30=a4=0.90, an average thickness of {100} tabular grains having an aspect ratio of from 2 to 30=a5=0.09 μm, a coefficient of variation of thickness distribution (thickness standard deviation/average thickness) of {100} tabular grains having an aspect ratio of from 2 to 30=a6=0.11, (the sum of projected areas of those {100} tabular grains having an aspect ratio of from 2 to 30 in which two dislocation lines extending from grain corners are observable under TEM)/(the sum of projected areas of {100} tabular grains having an aspect ratio of from 2 to 30)×100=a7=87%, and an average of angles between two dislocation lines=a8=56°.

When a direct TEM image of the tabular grains was taken, dislocation lines were observable for those grains accounting for 57% of the projected area even in the emulsion after coating.

When a sample was observed at an observation temperature of −120° C. under a transmission electron microscope 4000EX (by Nippon Electron K.K.) while tilting the sample, the disappearance of dislocation lines was found, confirming that these dislocation lines accorded with screw dislocation.

Emulsion B: {111} AgBr Tabular Grains

A reactor was charged with a solution of 6.0 g of potassium bromide and 7.0 g of a low molecular weight gelatin having Mw 15,000 in 1 liter of water and maintained at 55° C. With stirring, 37 ml of an aqueous silver nitrate solution containing 4.00 g of silver nitrate and 38 ml of an aqueous solution containing 5.9 g of potassium bromide were added over 37 seconds by the double jet method. After 18.6 g of gelatin was added, the temperature was raised to 70° C. and 89 ml of an aqueous silver nitrate solution containing 9.80 g of silver nitrate was added over 22 minutes. With 7 ml of 25% aqueous ammonia added, the solution was physically ripened for 10 minutes with the temperature unchanged, and then 6.5 ml of a 100% aqueous acetic acid solution was added. Subsequently, 435 ml of an aqueous solution containing 153 g of silver nitrate and 677 ml of an aqueous solution containing 573 g of potassium bromide were added over 35 minutes by the controlled double jet method while maintaining at pAg 8.5, until the silver nitrate solution was entirely added. Then 15 ml of a 2N potassium thiocyanate solution was added. The solution was physically ripened for 5 minutes with the temperature unchanged and then cooled to 35° C. There was obtained a monodisperse emulsion of pure silver bromide {111} tabular grains having a1=95%, a2=12.0, a3=1.20 μm, a5=0.10 μm, and a coefficient of variation of the projected area diameter of 15.5%.

Thereafter, the soluble salts were removed by flocculation. After the temperature was raised again to 40° C., 30 g of deionized, alkali-treated gelatin, 2.35 g of phenoxyethanol, and 0.8 g of sodium polystyrenesulfonate as a thickener were added to the emulsion, which was adjusted to pH 5.90 and pAg 8.00 with solutions of sodium hydroxide and silver nitrate.

Emulsion C: high Br Content {100} Tabular Grains

A reactor was charged with an aqueous gelatin solution (containing 25 g of gelatin and 0.11 g of NaCl in 1.2 liters of $H_2O$, adjusted to pH 3.9 with a $HNO_3$ solution) and kept at 40° C. With stirring, 8.0 ml of a Ag-1 solution (containing 10 g/liter of $AgNO_3$) was added within 2 seconds. After 5 minutes, a X-1 solution (containing 140 g/liter of KBr) and a Ag-2 solution (containing 200 g/liter of $AgNO_3$) were substantially concurrently added over 1 minute at a rate of 50 ml/min and mixed. The start of addition of the X-1 solution preceded 1 second the start of addition of the Ag-2 solution. After 1 minute from the completion of addition, a NaOH solution was added to adjust to pH 5.5. Further, an aqueous solution of polyvinyl alcohol (containing 5 g of a polyvinyl alcohol derived from polyvinyl acetate with an average degree of polymerization of 500 and having an average saponification to alcohol of 98% in 50 ml of $H_2O$) and an aqueous solution of a polyvinyl imidazole copolymer (containing 10 g of a polyvinyl imidazole copolymer represented by the formula shown below wherein x:y:z:w=60:7:13:30 and having Mw=$1.5\times10^5$ in 100 ml of $H_2O$) were added to the solution, which was adjusted to a silver potential of 50 mV and then heated to a temperature of 75° C. After heating, the silver potential was re-adjusted to 50 mV. After 30 minutes of ripening, a Ag-3 solution (containing 100 g/liter of $AgNO_3$) and a X-2 solution (containing 71 g/liter of KBr) were added while keeping a silver potential of 50 mV. The Ag-3 solution was added over 30 minutes at an initial flow rate of 5 ml/min and a linear flow rate acceleration of 0.05 ml/min. After 3 minutes, a flocculant was added to the emulsion, which was cooled to a temperature of 30° C. and adjusted to pH 4.0, causing coagulation. After the coagulated emulsion was washed with water, it was heated to 38° C., a gelatin solution was added, and the emulsion was dispersed again. A TEM image of a replica of the resulting emulsion grains was taken and its observation revealed the following. Those grains having {100} faces as major faces accounted for 92% of the total of projected areas of all AgX grains, the projected outline shape was a rectangular parallelepiped shape in which one or two of the four corners were chipped, with an average corner chipping being about 10% of the edge length. The edge face having chipped corners was a {110} face. The grains had an average diameter of 1.4 μm, an average aspect ratio of 10.0, and a coefficient of variation of diameter distribution (standard deviation/average diameter) of 0.21.

Polyvinyl imidazole copolymer

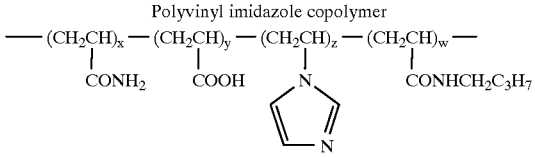

(x = 60, y = 7, z = 13, w = 30)

Chemical Sensitization

While keeping at 56° C. with stirring, each of the above-prepared emulsions was subject to chemical sensitization. First, Thiosulfonic acid compound-1 (shown below) was added in an amount of $1\times10^{-4}$ mol per mol of silver halide. Then AgBr fine grains having a mean grain diameter of 0.10 μm were added in an amount of 1.0 mol % based on the total silver amount. After 5 minutes, a 1 wt% KI solution was added in an amount of $1\times10^{-3}$ mol per mol of silver halide. After 3 minutes, $1\times10^{-6}$ mol/mol of Ag of thiourea dioxide was further added to the emulsion, which was kept at the temperature for 22 minutes for reduction sensitization. Then, $3\times10^{-4}$ mol/mol of Ag of 4-hydroxy-6-methyl-1,3,3a,7-tetraazaindene and Sensitizing dye-1, 2, 3 and 4 (shown below together with their amounts) were added. Further, $1\times10^{-2}$ mol/mol of Ag of calcium chloride was added. Further, $1\times10^{-5}$ mol/mol of Ag of chloroauric acid and $3.0\times10^{-3}$ mol/mol of Ag of potassium thiocyanate were added. In succession, $6\times10^{-6}$ mol/mol of Ag of sodium thiosulfate, $4\times10^{-6}$ mol/mol of Ag of Selenium compound-1 (shown below), and $3\times10^{-6}$ mol/mol of Ag of Tellurium compound-1 were added to the emulsion. After 3 minutes, 0.5 g/mol of Ag of nucleic acid was added. After 40 minutes, water-soluble Mercapto compound-$_1$ (shown below) was added to the emulsion, which was cooled to 35° C. In this way, the preparation or chemical ripening of the emulsion was completed.

Thiosulfonic acid compound-1
$C_2H_5SO_2SNa$
Sensitizing dye-1
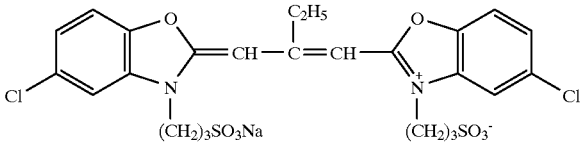
1 x $10^{-3}$ mol/mol of Ag
Sensitizing dye-2
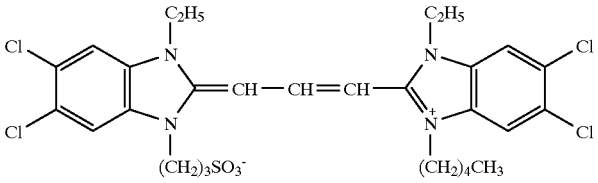
1 x $10^{-5}$ mol/mol of Ag
Sensitizing dye-3
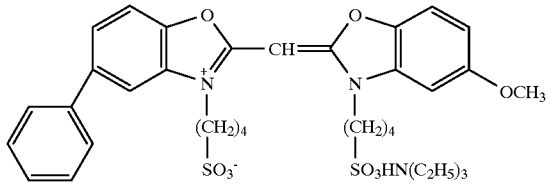
3 x $10^{-4}$ mol/mol of Ag
Sensitizing dye-4
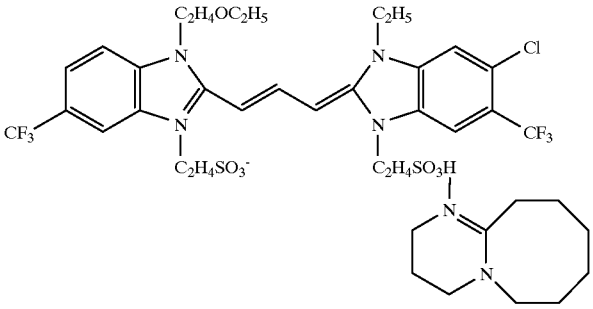
5 x $10^{-4}$ mol/mol of Ag
Selenium compound-1
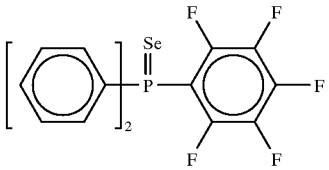
Tellurium compound-1
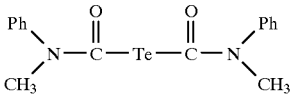
Mercapto compound-1
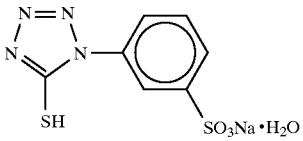

Preparation of Emulsion Layer Coating Solution

An emulsion layer coating solution was obtained by adding the following chemicals to the chemically sensitized emulsion. The amounts of the chemicals are per mol of the silver halide.

| | |
|---|---|
| Gelatin (including gelatin in emulsion) | see Table 1 |
| Dextran (Mw 39,000) | 10.0 g |
| Sodium polyacrylate (Mw 4 × $10^5$) | 5.1 g |
| Sodium polystyrenesulfonate (Mw 6 × $10^5$) | 1.2 g |
| Potassium iodide | 78 mg |
| Hardener 1,2-bis(vinylsulfonylacetamide)ethane in an amount adjusted to provide a swelling factor shown in Table 1 | |
| Compound A-1 | 42.1 mg |
| Compound A-2 | 10.3 g |
| Compound A-3 | 0.11 g |
| Compound A-4 | 8.5 mg |
| Compound A-5 | 0.43 g |
| Compound A-6 | 0.04 g |
| Compound A-7 | see Table 1 |
| Dye emulsion a (as dye solids) | 0.50 g |
| Dye emulsion m (as dye solids) | 30 mg |
| (adjusted to pH 6.1 with NaOH) | |

compound A-1

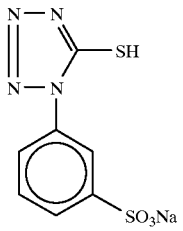

compound A-2

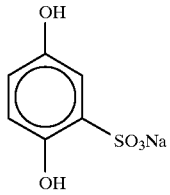

compound A-3

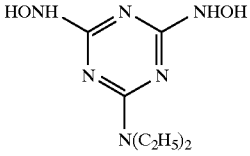

compound A-4

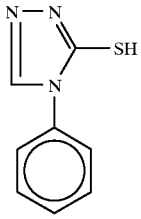

-continued compound A-5

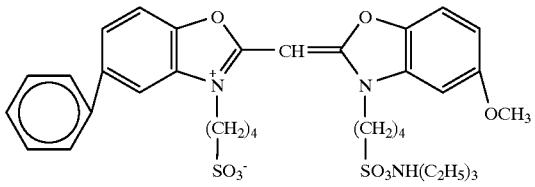

compound A-6

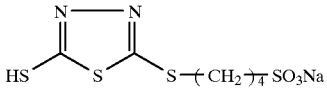

compound A-7

Core/shell latex core: shell = 50:50 wt % core: styrene/butadiene copolymer (37/63 wt %)

shell: styrene/2-acetoacetoxyethylmetacrylate (84/16 wt %)

average particle diameter~ 0.1 μm

Dye emulsions a and m used above were prepared as follows.

Preparation of Dye Emulsion a

Dye-1, 60 g, was dissolved in 62.8 g of 2,4-diaminophenol, 62.8 g of dicyclohexyl phthalate, and 333 g of ethyl acetate at 60° C. To the solution were added 65 ml of a 5% aqueous solution of sodium dodecylbenzenesulfonate, 94 g of gelatin, and 581 ml of water. The mixture was emulsified and dispersed for 30 minutes at 60° C. by means of a dissolver. Then 2 g of methyl p-hydroxybenzoate and 6 liters of water were added to the dispersion, which was cooled to 40° C. Using a ultrafiltration Labomodule ACP1050 by Asahi Chemicals K.K., the dispersion was concentrated to a total amount of 2 kg. Addition of 1 g of methyl p-hydroxybenzoate to the dispersion yielded Dye emulsion a.

Dye-1

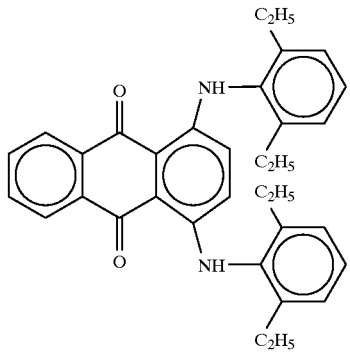

Preparation of Dye Emulsion m

Dye-2, 10 g, was dissolved in a solvent consisting of 10 ml of tricresyl phosphate and 20 ml of ethyl acetate. This was dispersed and emulsified in 100 ml of a 15 wt % gelatin aqueous solution containing 750 mg of Anionic surfactant-1, yielding Dye emulsion m.

Dye-2

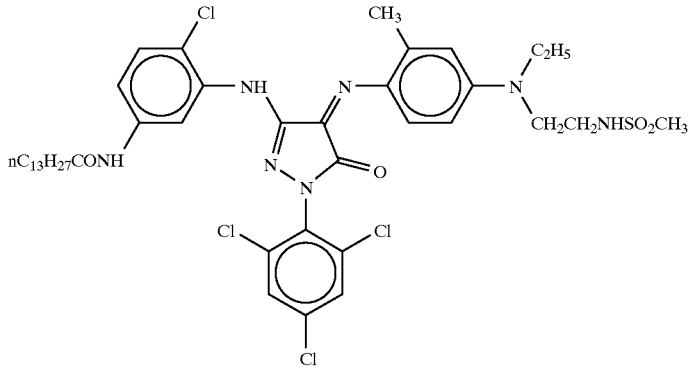

Anionic surfactant-1

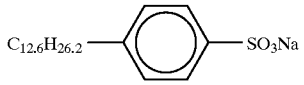

Preparation of Dye Layer Coating Solution

A coating solution was prepared by mixing the following ingredients so that the dye layer contained the respective ingredients in the following coverages.

| | |
|---|---|
| Gelatin | 0.25 g/m$^2$ |
| Compound A-8 | 1.4 mg/m$^2$ |
| Sodium polystyrenesulfonate (Mw 6 × 10$^5$) | 5.9 mg/m$^2$ |
| Dye dispersion i (as dye solids) | 20 mg/m$^2$ |

Compound A-8

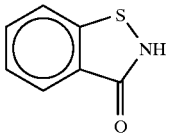

Dye emulsion i used above was prepared as follows.

Preparation of Dye Emulsion i

Dye-3 shown below was furnished as a wet cake without drying and weighed so as to give 6.3 g of dry solids. Dispersing aid V shown below was furnished as a 25 wt % aqueous solution and added to the wet cake of Dye-3 so as to provide 30% by weight of its dry solids based on the weight of the dye solids. Water was added to this to a total amount of 63.3 g. Thorough stirring resulted in a slurry. The slurry was admitted into a vessel together with 100 ml of zirconia beads having an average diameter of 0.5 mm, and dispersed for 6 hours by means of a dispersing machine 1/16G Sand Grinder Mill (Imex K.K.). Water was added to form a dye dispersion having a dye concentration of 8% by weight.

The dye dispersion was mixed with the remaining components such that the dye solid content was 5% by weight and the content of photographic gelatin was equal in % by weight to the dye solid content. An aqueous solution of additive D (shown below) as an antiseptic was added to the dispersion so as to give 2,000 parts of additive D per million parts by weight of gelatin. The dispersion was refrigerated and stored in jelly form.

In this way, dye dispersion i was obtained in the form of a non-leachable solid particle dispersion of dye having a light absorption maximum at 915 nm. The solid fine particles of dye dispersion i had an average particle diameter of 0.4 $\mu$m.

Dye-3

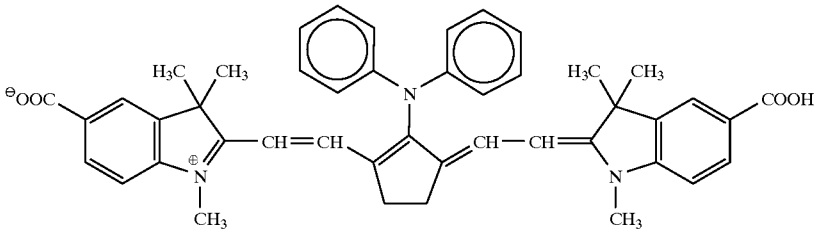

Dispersing aid V

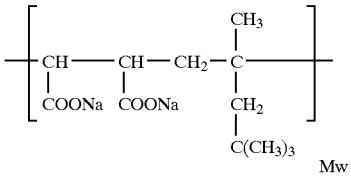

Mw = 14,300

-continued

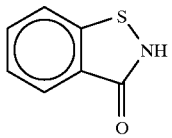

Preparation of Surface Protective Layer Coating Solution

A surface protective layer coating solution was prepared by mixing the following components so that the respective components gave the following coverage.

| Component | Coverage |
|---|---|
| Gelatin | 0.780 g/m$^2$ |
| Sodium polyacrylate (Mw 4 × 10$^5$) | 0.025 g/m$^2$ |
| Sodium polystyrenesulfonate (Mw 6 × 10$^5$) | 0.0012 g/m$^2$ |
| Matte agent-1 (average particle diameter 3.7 μm) | 0.072 g/m$^2$ |
| Matte agent-2 (average particle diameter 0.7 μm) | 0.010 g/m$^2$ |
| Compound A-9 | 0.018 g/m$^2$ |
| Compound A-10 | 0.037 g/m$^2$ |
| Compound A-11 | 0.0068 g/m$^2$ |
| Compound A-12 | 0.0032 g/m$^2$ |
| Compound A-13 | 0.0012 g/m$^2$ |
| Compound A-14 | 0.0022 g/m$^2$ |
| Compound A-15 | 0.030 g/m$^2$ |
| Pxoxisel (ICI) (adjusted to pH 6.8 with NaOH) | 0.0010 g/m$^2$ |

Note that the addenda used herein are shown below.

Matte agent

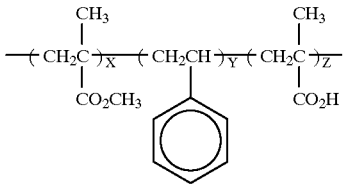

Matte agent-1 X/Y/Z = 76.3/17.5/6.2
Matte agent-2 X/Y/Z = 70/15/15

Compound A-9

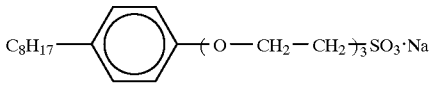

Compound A-10

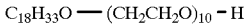

Compound A-11

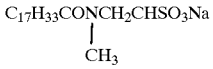

Compound A-12

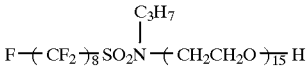

Compound A-13

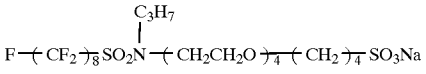

Additive D

-continued compound A-14

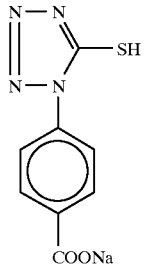

compound A-15

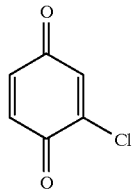

Preparation of Support (1) Preparation of undercoat layer dye dispersion B

Dye-4 (shown below) was ball milled by the method of JP-A 197943/1988.

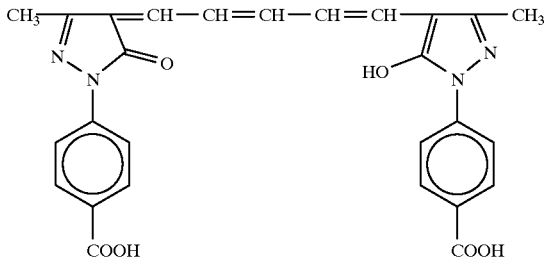

A 2-liter ball mill was charged with 434 ml of water and 791 ml of a 6.7% aqueous solution of Triton® surfactant. To the solution was added 20 g of Dye-4. With 400 ml of zirconia ($ZrO_2$) beads having a diameter of 2 mm added, the contents were milled for 4 days. Thereafter, 160 g of a 12.5% gelatin solution was added. After deaeration, the zirconia beads were removed by filtration. The resulting dye dispersion was examined to find that the milled dye had a broad particle size distribution from 0.05 μm to 1.15 μm and an average particle diameter of 0.37 μm. Coarse dye particles having a diameter of more than 0.9 μm were removed by centrifugation. A dye dispersion B was obtained in this way.

(2) Preparation of Support

A biaxially oriented polyethylene terephthalate film of 175 μm thick was subject to a corona discharge. The PET used herein contained 0.04% by weight of Dye-1 (shown above). A first undercoat solution of the composition shown below was coated on one surface of the PET film to a coverage of 4.9 ml/m$^2$ by a wire bar coater and dried at 185°

C. for one minute to form a first undercoat layer. Another first undercoat layer was similarly formed on the opposite surface.

| First undercoat solution | |
|---|---|
| Butadiene-styrene copolymer latex solution (solids 40%, butadiene/styrene weight ratio = 31/69) | 158 ml |
| 4% solution of sodium 2,4-dichloro-6-hydroxy-s-triazine | 41 ml |
| Distilled water | 801 ml |

Note that the latex solution contained 0.4% by weight based on the latex solids of Compound A-16 (shown below) as a dispersing/emulsifying agent.

Compound A-16

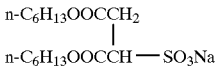

(3) Coating of undercoat layer

On each of the first undercoat layers, a second undercoat solution of the composition shown below was coated to a coverage as shown below by a wire bar coater and dried at 155° C. to form a second undercoat layer.

| Second undercoat solution | |
|---|---|
| Gelatin | 100 mg/m$^2$ |
| Dye dispersion B (as dye solids on one surface) | see Table 1 |
| Compound A-17 | 1.8 g/m$^2$ |
| Compound A-18 | 0.27 g/m$^2$ |
| Matte agent, polymethyl methacrylate (average particle diameter 2.5 $\mu$m) | 2.5 g/m$^2$ |

Compound A-17
$C_{12}H_{25}O(CH_2CH_2O)_{10}H$
Compound A-18

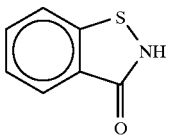

Preparation of Photographic Element

On the support prepared as above, the above-mentioned dye layer, emulsion layer, and surface protective layer coating solutions were coated by a co-extrusion method and dried, forming three layers on each surface. The silver coverage was 1.4 g/m$^2$ and the overall gelatin coverage was as shown in Table 1, both on one surface. Coated sample Nos. 1 to 17 were prepared in this way.

Measurement of Swelling Factor

A photosensitive element sample was allowed to stand for 7 days at 40° C. and RH 60%. The sample was dipped in distilled water at 21° C. for 3 minutes and then frozen for fixation with liquefied nitrogen. Using a microtome, the same was sectioned perpendicular to its surface and freeze dried at −90° C. The sample treated as above was observed under a scanning electron microscope (SEM) to determine the thickness (Tw) of the swollen sample. The thickness (Td) of the dry sample was similarly determined in advance by a sectional observation under SEM. The swelling factor is calculated in accordance with (Tw−Td)/Td×100%.

These photographic element samples had a swelling factor with water as reported in Table 1.

The above-prepared photosensitive element samples were processed and evaluated for several properties. First, the processing solutions and conditions are described.

Preparation of Developer

A developer of the following formulation containing sodium erythorbate as a developing agent was prepared.

| | |
|---|---|
| Diethylenetriaminepentaacetic acid | 8.0 g |
| Sodium sulfite | 20.0 g |
| Sodium carbonate monohydrate | 52.0 g |
| Potassium carbonate | 55.0 g |
| Sodium erythorbate | 60.0 g |
| 4-hydroxymethyl-4-methyl-1-phenyl-3-pyrazolidone | 13.2 g |
| 3,3'-diphenyl-3,3'-dithiopropionic acid | 1.44 g |
| Diethylene glycol | 50.0 g |
| 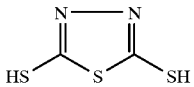 | 0.15 g |
| 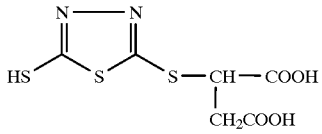 | 0.3 g |
| 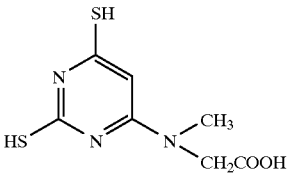 | 1 mmol/l |
| 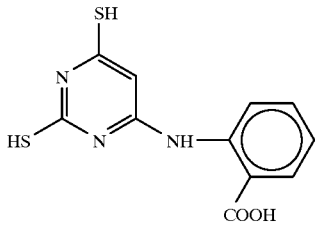 | 1 mmol/l |
| Water to make (adjusted to pH 10.1 with sodium hydroxide) | 2 liters |

Preparation of Developer Replenisher

The developer prepared above was used as a developer replenisher without further dilution.

Preparation of Developing Tank Solution

A developing tank solution at pH 9.5 was prepared by taking 2 liters of the developer and adding 55 ml per liter of the developer of a starter of the following composition.

| Starter | |
|---|---|
| Potassium bromide | 11.1 g |
| Acetic acid | 10.8 g |
| Water to make | 55 ml |

Preparation of Fixer Concentrate

A fixer concentrate of the following composition was prepared.

| | |
|---|---|
| Water | 0.5 liter |
| Ethylenediaminetetraacetic acid dihydrate | 0.05 g |
| Sodium thiosulfate | 200 g |
| Sodium bisulfite | 98.0 g |
| Sodium hydroxide | 2.9 g |
| Water to make (adjusted to pH 5.2 with sodium hydroxide) | 1 liter |

Preparation of Fixer Replenisher

A fixer replenisher was obtained by diluting the fixer concentrate with used water from the first washing step by a factor of 2 by volume.

Preparation of Fixing Tank Solution

A fixing tank solution at pH 5.4 was prepared by diluting 2 liters of the fixer concentrate with water to a total volume of 4 liters.

Preparation of Washing Water Replenisher

| | |
|---|---|
| Glutaraldehyde | 0.3 g |
| Diethylenetriaminepentaacetic acid | 0.5 g |

These ingredients were diluted with distilled water and adjusted to pH 4.5 with NaOH, obtaining 1 liter of a washing water replenisher.

Processing of Photographic Element

An automatic processor CEPROS-S (Fuji Photo Film Co., Ltd.) was tailored. The washing tank was modified into two-stage counter-current washing tanks. Washing water was replenished to the second washing tank. The washing tanks each had a volume of 6 liters. The developing and fixing tanks each had an aperture of 0.02 $cm^{-1}$. Drying relied on a heat roller system using a heat roller which was heated to a surface temperature of 85° C.

By using the above-prepared developer and fixer tank solutions and washing water replenisher and replenishing the developer, fixer and washing water replenishers at a rate of 65 $ml/m^2$ of the photosensitive element, 2,000 quarter-size sheets were processed whereupon a substantially equilibrium state was established. The drag-outs of the developer, the fixer and the wash water were determined. For example, the drag-out of the developer was determined by previously measuring the specific gravity of the developer solution, emptying the fixing tank of the fixer solution, processing quarter-size sheets in the developing tank, and measuring the weight of the processed sheets immediately after they entered the fixing tank. The measurement was an average of ten quarter-size sheets for each of the photosensitive element samples. The drag-outs of the fixer and the wash water were similarly determined.

The results are shown in Table 1. It is noted that the quarter-size is 10×12 inches or equal to 774.7 $cm^2$.

| Step | Temp. | Processing time |
|---|---|---|
| Development | 35° C. | 8 sec. |
| Fixation | 35° C. | 7 sec. |
| 1st washing | 30° C. | 5 sec. |
| 2nd washing | 25° C. | 5 sec. |
| Drying | | 3 sec. |
| Total | | 28 sec. |

Evaluation of Photographic Properties

A photographic element sample was exposed to radiation for 0.05 sec. from both sides through x-ray ortho-screens HGM and HGH manufactured by Fuji Photo Film Co., Ltd. After exposure, it was processed as above and evaluated for sensitivity. The sensitivity is the reciprocal of a ratio of an exposure to provide a density of fog+1.0, and expressed relative to 100 for sample No. 1.

Evaluation of Silver Sludging

At the end of the running process, the developing tank was visually inspected for silver sludging.

○: no sludging

×: silver sludging

Evaluation of Fixing Function

An unexposed photosensitive element sample was visually inspected for under-fixed silver.

○: good

Δ: some uneven uncleared areas, but photographically acceptable

×: poor

Evaluation of Drying Function

A drying level was evaluated by a sensory test of touching a sheet emerging from the drying zone outlet. The sheet was rated "○" when it was fully dry and "×" when it was somewhat moist.

Drying uniformity was evaluated by examining for reflecting gloss a sheet emerging from the drying zone outlet. The sheet was rated "○" when its gloss was even and "×" when its gloss was uneven.

Coloring of the Fixing Tank

○: not colored

Δ: colored pale blue, but clear and practically safe

×: colored blue black, opaque, deposits on rollers

Coloring of the Washing Tanks

○: not colored

Δ: colored faintly red, but clear and practically safe

×: colored red, opaque, deposits on rollers

Residual Color on Photosensitive Element

○: no residual color

Δ: faint residual color when carefully viewed, but practically acceptable

×: apparent residual color, photosensitive element was dark and dull to view

Evaluation of Crossover

Using a cassette, a GRENEX ortho-screen HR-4 (manufactured by Fuji Photo Film Co., Ltd.) was placed close to one surface of the sample, which was examined by x-ray sensitometry. After the same processing as done in the evaluation of photographic performance, the sensitivity of the surface in contact with the screen (front surface) and the sensitivity of the opposite surface (back surface) were determined. The sensitivity is logE wherein E is an exposure necessary to provide a density higher by 1.0 than the density of base+fog. Using the difference between these sensitivities, the percent crossover light was calculated according to the following equation.

$$\text{Crossover light } (\%)=1/\{\text{antilog}(\Delta\log E)+1\}\times 100$$

Evaluation of Acutance (MTF)

A modulation transfer function (MTF) value was measured with the above-mentioned combination of HR-4 screen with the automatic processor. Using a MTF value obtained at an aperture of 30 μm×500 μm and a space frequency of 1.0 cycle/mm, evaluation was made on a portion having an optical density of 1.0. MTF values of 0.70 or higher are acceptable.

The results are shown in Tables 1 and 2.

TABLE 1

| Sample No. | Emulsion | Dye-4 coverage ($mg/m^2$) | Gelatin coverage on one surface ($g/m^2$) | Compound A-7 coverage on one surface ($g/m^2$) | A-7/ gelatin (wt %) | Swelling factor (%) | Cross-over (%) | Developer drag-out (ml) | Fixer drag-out (ml) | First wash water drag-out (ml) | Last wash water drag-out (ml) |
|---|---|---|---|---|---|---|---|---|---|---|---|
| 1* | A | 50 | 2.5 | 0.3 | 12 | 220 | 7 | 1.7 | 1.5 | 1.8 | 1.5 |
| 2* | A | 50 | 2.1 | 0.7 | 33 | 150 | 7 | 1.2 | 1.1 | 1.4 | 1.2 |
| 3 | A | 50 | 1.7 | 1.1 | 65 | 100 | 7 | 0.9 | 0.8 | 1.1 | 0.9 |
| 4 | A | 50 | 1.3 | 1.5 | 115 | 70 | 7 | 0.7 | 0.7 | 0.9 | 0.6 |
| 5 | A | 50 | 0.7 | 2.1 | 300 | 30 | 7 | 0.5 | 0.5 | 0.7 | 0.2 |
| 6* | B | 50 | 2.5 | 0.3 | 12 | 220 | 7 | 1.7 | 1.5 | 1.8 | 1.5 |
| 7* | B | 50 | 2.1 | 0.7 | 33 | 150 | 7 | 1.2 | 1.1 | 1.4 | 1.2 |
| 8 | B | 50 | 1.7 | 1.1 | 65 | 100 | 7 | 0.9 | 0.8 | 1.1 | 0.9 |
| 9 | B | 50 | 1.3 | 1.5 | 115 | 70 | 7 | 0.7 | 0.7 | 0.9 | 0.6 |
| 10 | B | 50 | 0.7 | 2.1 | 300 | 30 | 7 | 0.5 | 0.5 | 0.7 | 0.2 |
| 11* | C | 50 | 2.5 | 0.3 | 12 | 220 | 7 | 1.7 | 1.5 | 1.8 | 1.5 |
| 12* | C | 50 | 2.1 | 0.7 | 33 | 150 | 7 | 1.2 | 1.1 | 1.4 | 1.2 |
| 13 | C | 50 | 1.7 | 1.1 | 65 | 100 | 7 | 0.9 | 0.8 | 1.1 | 0.9 |
| 14 | C | 50 | 1.3 | 1.5 | 115 | 70 | 7 | 0.7 | 0.7 | 0.9 | 0.6 |
| 15 | C | 50 | 0.7 | 2.1 | 300 | 30 | 7 | 0.5 | 0.5 | 0.7 | 0.2 |
| 16* | A | 25 | 2.5 | 0.3 | 12 | 220 | 19 | 1.7 | 1.5 | 1.8 | 1.5 |
| 17* | A | 0 | 2.5 | 0.3 | 12 | 220 | 19 | 0.7 | 0.7 | 0.9 | 0.6 |

*Comparison

TABLE 2

| Sample No. | Sensitivity | Silver sludging | Drying level | Drying uniformity | Fixing function | Fixing tank coloring | 1st wash tank coloring | Residual color | Acutance (MTF) |
|---|---|---|---|---|---|---|---|---|---|
| 1* | 100 | × | × | × | × | × | × | × | 0.76 |
| 2* | 100 | × | × | × | Δ | × | × | × | 0.76 |
| 3 | 120 | ○ | ○ | ○ | ○ | ○ | ○ | ○ | 0.76 |
| 4 | 120 | ○ | ○ | ○ | ○ | ○ | ○ | ○ | 0.76 |
| 5 | 100 | ○ | ○ | ○ | ○ | ○ | ○ | ○ | 0.76 |
| 6* | 70 | × | × | × | × | × | × | × | 0.72 |
| 7* | 90 | ○ | × | × | × | × | × | × | 0.72 |
| 8 | 90 | ○ | ○ | ○ | ○ | ○ | ○ | ○ | 0.72 |
| 9 | 80 | ○ | ○ | ○ | ○ | ○ | ○ | ○ | 0.72 |
| 10 | 60 | ○ | ○ | ○ | Δ | Δ | Δ | Δ | 0.72 |
| 11* | 80 | × | × | × | × | × | × | × | 0.73 |
| 12* | 100 | ○ | × | × | × | × | × | × | 0.73 |
| 13 | 100 | ○ | ○ | ○ | ○ | ○ | ○ | ○ | 0.73 |
| 14 | 90 | ○ | ○ | ○ | ○ | ○ | ○ | ○ | 0.73 |
| 15 | 90 | ○ | ○ | ○ | ○ | ○ | ○ | ○ | 0.73 |
| 16* | 100 | × | × | × | × | ○ | ○ | ○ | 0.63 |
| 17* | 120 | ○ | ○ | ○ | ○ | ○ | ○ | ○ | 0.63 |

*Comparison

It is evident from Tables 1 and 2 that the image forming system according to the invention can produce satisfactory photographic images featuring high sharpness and high sensitivity and free of residual color. The fixing function and drying efficiency are high. Uneven drying is substantially eliminated. No silver sludging occurs. The processing solutions were little or not colored.

In all the runs, the waste of wash water was used as diluent water for the fixer replenisher, achieving zero waste of wash water.

Example 2

The same run as in Example 1 was carried out using automatic processors CEPROS P, CEPROS M2, and CEPROS 30 by Fuji Photo Film Co., Ltd. The results were the same as in Example 1, confirming that the invention provides a satisfactory image forming system.

Example 3

Preparation of Fixer

A fixer of the following composition was prepared.

| | |
|---|---|
| Disodium ethylenediaminetetraacetate dihydrate | 0.05 g |
| Sodium thiosulfate pentahydrate | 150.0 g |
| Sodium sulfite | 5.0 g |
| Succinic acid | 0.2 mol |
| Water to make | 1 liter |
| (adjusted to pH 5.2 with sodium hydroxide) | |

The fixer tank solution and the fixer replenisher were identical and of the above composition.

Sample Nos. 3, 4, 5, 8, 9, 10, 13, 14, and 15 of Example 1 were similarly processed using the fixer of the above formulation. They were similarly tested. The samples within the scope of the invention showed excellent results with respect to silver sludging, fixing function, drying efficiency, uneven drying, coloring of the fixing tank, coloring of the washing tanks, residual color, and sharpness. The crossover was 7%. The fixer was free of acetic acid odor.

Japanese Patent Application No. 117559/1997 is incorporated herein by reference.

Reasonable modifications and variations are possible from the foregoing disclosure without departing from either the spirit or scope of the present invention as defined by the claims.

We claim:

1. A method for processing a photographic silver halide photosensitive element having a photosensitive silver halide emulsion layer on either surface of a support and a crossover light quantity of up to 15% using an automatic processor, comprising the steps of developing the photosensitive element with a developer, fixing with a fixer, and then washing with water, wherein in the step of developing the photosensitive element with the developer, said developer contains an ascorbic acid compound as a developing agent, and said developer is carried over in an amount of up to 1.0 ml per 10×12-inch size sheet of the photosensitive element.

2. The method of claim 1 wherein in the step of fixing the photosensitive element with the fixer, said fixer is carried over in an amount of up to 1.0 ml per 10×12-inch size sheet of the photosensitive element.

3. The method of claim 1 wherein the step of washing the photosensitive element with water is a multi-stage washing step including at least a first washing tank and a last washing tank, and wash water is carried over from the first washing tank in an amount of up to 1.0 ml per 10×12-inch size sheet of the photosensitive element.

4. The method of claim 1 wherein the step of washing the photosensitive element with water is a multi-stage washing step including at least a first washing tank and a last washing tank, and wash water is carried over from the last washing tank to a drying zone in an amount of up to 1.0 ml per 10×12-inch size sheet of the photosensitive element.

5. The method of claim 1 wherein the step of washing the photosensitive element with water is a multi-stage washing step, and substantially no waste solution of wash water is left after the washing step.

6. The method of claim 1 wherein at least one of the photosensitive silver halide emulsion layers is comprised of an emulsion of tabular silver halide grains having an average aspect ratio of at least 2.

7. The method of claim 6 wherein the tabular silver halide grains have a silver chloride content of at least 50 mol %.

8. The method of claim 1 wherein said photographic silver halide photosensitive element contains a coverage of a hydrophilic colloid and a coverage of a polymer latex, the polymer latex coverage being at least 10% by weight of the colloid coverage, and said photographic silver halide photosensitive element has a swelling factor with water of up to 150%.

9. The method of claim 8 wherein the hydrophilic colloid is coated in a coverage of 0.5 to 3 g per square meter of one surface of the photosensitive element.

10. The method of claim 9 wherein the hydrophilic colloid is coated in a coverage of 1.0 to 2.2 g per square meter of one surface of the photosensitive element.

11. The method of claim 8 wherein the polymer latex is contained in an amount of at least 10% by weight of the hydrophilic colloid as a binder.

12. The method of claim 8 wherein the swelling factor is 30% to 150%.

13. The method of claim 12 wherein the swelling factor is 50% to 120%.

14. The method of claim 8 wherein the coverage of the polymer latex divided by the coverage of the hydrophilic binder is 25 to 400% by weight.

15. The method of claim 2 wherein said fixer contains at least 0.15 mol/liter of succinic acid.

16. The method of claim 1 wherein the drag-out of the developer is from 0.1 ml to 1.0 ml per 10×12-inch size sheet.

17. The method of claim 2 wherein the drag-out of the fixer is from 0.1 ml to 1.0 ml per 10×12-inch size sheet.

18. The method of claim 4 wherein the drag-out of the wash water is from 0.1 to 1.0 ml per 10×12-inch size sheet.

19. The method of claim 1 wherein said developer contains 0.01 to 0.8 mol/liter of the ascorbic acid compound.

20. The method of claim 19 wherein said developer contains 0.1 to 0.4 mol/liter of the ascorbic acid compound.

* * * * *